US009849343B2

(12) United States Patent
Tachibana et al.

(10) Patent No.: US 9,849,343 B2
(45) Date of Patent: Dec. 26, 2017

(54) GOLF BALL

(71) Applicant: Dunlop Sports Co. Ltd., Kobe-shi, Hyogo (JP)

(72) Inventors: Kosuke Tachibana, Kobe (JP); Kazuya Kamino, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/099,186

(22) Filed: Apr. 14, 2016

(65) Prior Publication Data

US 2016/0310797 A1 Oct. 27, 2016

(30) Foreign Application Priority Data

Apr. 27, 2015 (JP) ..... 2015-090786

(51) Int. Cl.
*A63B 37/00* (2006.01)
*A63B 37/02* (2006.01)
*A63B 45/00* (2006.01)

(52) U.S. Cl.
CPC ..... *A63B 37/0084* (2013.01); *A63B 37/006* (2013.01); *A63B 37/0031* (2013.01); (Continued)

(58) Field of Classification Search
CPC ..... A63B 37/0076; A63B 37/0063; A63B 37/006; A63B 37/0092
See application file for complete search history.

(56) References Cited

U.S. PATENT DOCUMENTS

2003/0130065 A1 7/2003 Watanabe
2006/0229143 A1 10/2006 Watanabe et al.
(Continued)

FOREIGN PATENT DOCUMENTS

EP 3037137 A 6/2016
JP 10-328326 A 12/1998
(Continued)

OTHER PUBLICATIONS

Shore Durometer Conversion Chart—Thermal Tech Equipment Co. Inc.*

*Primary Examiner* — John E Simms, Jr.
(74) *Attorney, Agent, or Firm* — Birch, Stewart, Kolasch & Birch, LLP

(57) ABSTRACT

An object of the present invention is to provide a golf ball traveling a great distance on driver shots. The present invention provides a golf ball comprising a spherical core including an inner layer and an outer layer, wherein a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 70 in Shore C hardness, an angle α of a hardness gradient of the inner layer is 0° or more, a difference (α−β) between the angle α and an angle β of a hardness gradient of the outer layer is 0° or more, and the intermediate layer has a highest hardness among the constituent members of the golf ball.

20 Claims, 3 Drawing Sheets

(52) U.S. Cl.
CPC ..... *A63B 37/0033* (2013.01); *A63B 37/0043* (2013.01); *A63B 37/0044* (2013.01); *A63B 37/0045* (2013.01); *A63B 37/0062* (2013.01); *A63B 37/0063* (2013.01); *A63B 37/0064* (2013.01); *A63B 37/0076* (2013.01); *A63B 37/0092* (2013.01); *A63B 37/0096* (2013.01); *A63B 45/00* (2013.01)

(56) References Cited

U.S. PATENT DOCUMENTS

| | | | | |
|---|---|---|---|---|
| 2007/0259739 | A1 | 11/2007 | Kasashima et al. | |
| 2008/0161132 | A1 | 7/2008 | Sullivan et al. | |
| 2008/0305890 | A1* | 12/2008 | Watanabe ..... | A63B 37/0063 473/373 |
| 2011/0143862 | A1* | 6/2011 | Watanabe ..... | A63B 37/0076 473/373 |
| 2012/0165127 | A1* | 6/2012 | Sajima ..... | A63B 37/0076 473/377 |
| 2012/0252604 | A1 | 10/2012 | Okabe et al. | |
| 2012/0329576 | A1 | 12/2012 | Sullivan et al. | |
| 2013/0029789 | A1* | 1/2013 | Sullivan ..... | A63B 37/0062 473/376 |
| 2013/0172113 | A1* | 7/2013 | Isogawa ..... | A63B 37/0003 473/373 |
| 2013/0296073 | A1* | 11/2013 | Nakamura ..... | A63B 37/0063 473/371 |
| 2013/0324316 | A1* | 12/2013 | Isogawa ..... | A63B 37/0054 473/373 |
| 2014/0018191 | A1* | 1/2014 | Watanabe ..... | A63B 37/0076 473/376 |
| 2015/0051017 | A1* | 2/2015 | Sullivan ..... | A63B 37/0003 473/374 |
| 2015/0119170 | A1 | 4/2015 | Tachibana et al. | |
| 2016/0184657 | A1 | 6/2016 | Tachibana et al. | |

FOREIGN PATENT DOCUMENTS

| | | | |
|---|---|---|---|
| JP | 10-328328 | A | 12/1998 |
| JP | 11-206920 | A | 8/1999 |
| JP | 2000-60997 | A | 2/2000 |
| JP | 2003-190331 | A | 7/2003 |
| JP | 2006-289065 | A | 10/2006 |
| JP | 2007-190382 | A | 8/2007 |
| JP | 2009-219871 | A | 10/2009 |
| JP | 2010-188199 | A | 9/2010 |
| JP | 2013-31778 | A | 2/2013 |

* cited by examiner

GOLF BALL

FIELD OF THE INVENTION

The present invention relates to a golf ball.

DESCRIPTION OF THE RELATED ART

A golfer's foremost requirement for a golf ball is flight performance. In particular, the golfer places importance on the flight performance on driver shots. The flight performance correlates with resilience performance of the golf ball. When a golf ball having an excellent resilience performance is hit, the golf ball flies at a high speed, thereby achieving a long flight distance.

An appropriate trajectory height is required in order to achieve a long flight distance. The trajectory height depends on a spin rate and a launch angle. The golf ball that achieves a high trajectory by a high spin rate travels an insufficient flight distance. The golf ball that achieves a high trajectory by a high launch angle travels a long flight distance. If a core having an outer-hard and inner-soft structure is adopted, a low spin rate and a high launch angle are achieved.

For example, Japanese Patent Publications No. H11-206920 A, No. 2003-190331 A, No. 2006-289065 A, No. 2007-190382 A, No. H10-328326 A, No. H10-328328 A, No. 2000-060997 A, No. 2009-219871 A, No. 2010-188199 A, and No. 2013-31778 A disclose golf balls for which the hardness distribution or outer diameter of a two-layered core has been discussed from the standpoint of achieving various performances. Japanese Patent Publication No. H11-206920 A discloses a multi-piece solid golf ball having a multiple-layered construction including: an elastic rubber having an inner layer and an outer layer as a core, and a hard elastic body as a cover layer, wherein the inner layer of the core has a diameter of 20 to 35 mm and a surface hardness (Shore D) of 30 to 50, the outer layer of the core has a thickness of 2 to 11 mm and a surface hardness (Shore D) of 35 to 60, the hardness decreases from the surface of the outer layer toward the central point of the core, and a hardness difference at a boundary interface between the inner layer and the outer layer of the core is 7 or less. (refer to Japanese Patent Publication No. H11-206920 A (claim 1)).

Japanese Patent Publication No. 2003-190331 A discloses a three-piece solid golf ball comprising an inner layer core formed from a rubber composition, an outer layer core formed from a rubber composition and covering the inner layer core, and a cover covering the outer layer core, wherein a JIS-C hardness of the inner layer core is within a range from 50 to 85, a JIS-C hardness of the outer layer core is within a range from 70 to 90, and a difference ($Ho-H_1$) between a JIS-C hardness Ho at a surface of the outer layer core and a JIS-C hardness $H_1$ at a central point of the inner layer core is 20 to 30 (refer to Japanese Patent Publication No. 2003-190331 A (claim 1)).

Japanese Patent Publication No. 2006-289065 A discloses a multi-piece solid golf ball comprising a core composed of multiple layers including at least an inner layer core and an outer layer core, and one or at least two cover layers covering the core, wherein (JIS-C hardness of cover)−(JIS-C hardness at central point of core)≥27; 23≤(JIS-C hardness at surface of core)−(JIS-C hardness at central point of core) ≤40; and 0.50≤[(flexure hardness of entire core)/(flexure hardness of inner layer core)]≤0.75 are satisfied (refer to Japanese Patent Publication No. 2006-289065 A (claim 1)).

Japanese Patent Publication No. 2007-190382 A discloses a golf ball comprising a central portion formed as an elastic solid core, wherein the core is harder at an outer portion thereof than at a center portion thereof, a JIS-C hardness difference between the core center portion and the core outer surface is 25 or more, the core has a double-layered construction composed of an inner layer and an outer layer, and the outer layer has a thickness of 5 to 15 mm (refer to Japanese Patent Publication No. 2007-190382 A (claims 2 to 4)).

Japanese Patent Publications No. H10-328326 A and No. H10-328328 A disclose a multi-piece solid golf ball comprising a core and a cover covering the core, wherein the core includes an inner core sphere and an envelope layer covering the inner core sphere, the cover includes an outer layer and an inner layer, a surface hardness of the envelope layer is higher than a surface hardness of the inner core sphere in Shore D, and a hardness of the inner core sphere is 3.0 to 8.0 mm in a deformation amount when a load of 100 kg is applied (refer to Japanese Patent Publications No. H10-328326 A (claim 1) and No. H10-328328 A (claim 1)).

Japanese Patent Publication No. 2000-060997 A discloses a multi-piece solid golf ball comprising a solid core, at least one envelope layer covering the core, an intermediate layer covering the envelope layer, and at least one cover layer covering the intermediate layer, wherein the hardness of the solid core is 2.5 to 7.0 mm in a deformation amount when a load of 100 kg is applied (refer to Japanese Patent Publication No. 2000-060997 A (claim 1)).

Japanese Patent Publication No. 2009-219871 A discloses a golf ball comprising a center, an outer core layer, an inner cover layer, and an outer cover layer, wherein the center is formed from a first rubber composition, has a diameter of 3.05 cm to 3.30 cm, and has a central hardness of 50 Shore C or more; the outer core layer is formed from a second rubber composition, and has a surface hardness of 75 Shore C or more; the inner cover layer is formed from a thermoplastic composition, and has a material hardness lower than the surface hardness of the outer core layer; and the outer cover layer is formed from a polyurethane or polyurea composition (refer to Japanese Patent Publication No. 2009-219871 A (claim 1)).

In addition, various constructions have been proposed for a golf ball comprising three pieces or more, depending on the required performances. For example, as a golf ball showing a good balance between the flight distance and the controllability performance, a golf ball having a hardest intermediate layer material hardness and a soft cover hardness among the constituent members thereof has been proposed. In such a golf ball, a high hardness resin such as an ionomer resin is mainly used as the intermediate layer material, and a low hardness resin such as a urethane resin is mainly used as the cover material.

For example, Japanese Patent Publication No. 2010-188199 A discloses a golf ball comprising an elastic rubber core, a cover having a plurality of dimples formed thereon, and at least one intermediate layer between the core and the cover, wherein the intermediate layer is composed of a resin material harder than the cover and a surface of the elastic core and has a thickness ranging from 0.5 to 3 mm and a Shore D hardness ranging from 50 to 67; the elastic core has a gradually increased hardness from a central point towards an outer end (core surface) thereof in a radial direction, a JIS-C hardness of the core central point ranges from 50 to 65, and a JIS-C hardness difference between the core central point and the core surface is at least 23; a value obtained by subtracting a hardness of the cover from a hardness of the intermediate layer is 2 or more in Shore D hardness; and a thickness of the cover ranges from 0.6 to 2.1 mm (refer to Japanese Patent Publication No. 2010-188199 A (claim 1)).

Japanese Patent Publication No. 2013-31778 A discloses a golf ball comprising an elastic rubber core, a cover having a plurality of dimples formed thereon, and at least one intermediate layer between the core and the cover, the elastic core being formed from a rubber composition including a polybutadiene, a metal salt of an unsaturated carboxylic acid, an organic peroxide, and a component selected from the group consisting of a thiophenol, a thionaphthol, a halogenated thiophenol and metal salts thereof, and the intermediate layer being formed from an ionomer resin or a mixture of an ionomer resin with a polyester elastomer, a polyurethane thermoplastic elastomer, a polyamide thermoplastic elastomer, a polyolefin thermoplastic elastomer or a polystyrene thermoplastic elastomer, wherein the intermediate layer is composed of a resin material harder than the cover and a surface of the elastic core and has a thickness ranging from 0.5 to 3 mm and a Shore D hardness ranging from 50 to 67; the elastic core has a gradually increased hardness from a central point towards an outer end (core surface) thereof in a radial direction, a JIS-C hardness of the core central point ranges from 50 to 65, and a JIS-C hardness difference between the core central point and the core surface ranges from 23 to 24; a value obtained by subtracting a hardness of the cover from a hardness of the intermediate layer is 2 or more in Shore D hardness; a hardness difference between the intermediate layer and the surface of the elastic core ranges from 6 to 22 in JIS-C hardness; and a thickness of the cover ranges from 0.6 to 2.1 mm (refer to Japanese Patent Publication No. 2013-31778 A (claim 1)).

SUMMARY OF THE INVENTION

As described above, various constructions have been proposed for the golf ball. However, there is still room for improvement in the flight distance on driver shots. For example, especially in a golf ball for an average golfer, if the hardness of the intermediate layer is soft, there are problems of an increased spin rate on driver shots, resulting in a lowered flight distance. The present invention has been achieved in view of the above circumstances, and an object of the present invention is to provide a golf ball traveling a great distance on driver shots.

The present invention that has solved the above problems provides a golf ball comprising a spherical core, an intermediate layer positioned outside the spherical core, and a cover positioned outside the intermediate layer, wherein the spherical core includes an inner layer and an outer layer, a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 70 in Shore C hardness, an angle $\alpha$ of a hardness gradient of the inner layer calculated by a formula (1) is 0° or more, a difference ($\alpha-\beta$) between the angle $\alpha$ and an angle $\beta$ of a hardness gradient of the outer layer calculated by a formula (2) is 0° or more, and the intermediate layer has a highest hardness among the constituent members of the golf ball, $$\alpha=(180/\pi)\times a\tan[\{H_{x-1}-Hoc\}/(X-1)] \quad (1)$$

$$\beta=(180/\pi)\times a\tan[\{H_{X+Y}-H_{x+1}\}/(Y-1)] \quad (2)$$

[where X represents a radius (mm) of the inner layer, Y represents a thickness (mm) of the outer layer, Hoc represents a center hardness (Shore C) of the spherical core, $H_{X-1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core].

In the golf ball according to the present invention, the relationship between the hardness gradient of the inner layer and the hardness gradient of the outer layer of the spherical core, the relationship between the inner layer hardness and the outer layer hardness near the boundary between the inner layer and the outer layer of the spherical core, and the hardness of the intermediate layer are optimized. As a result, for the golf ball according to the present invention, the ball initial velocity on driver shots is increased and the excessive spin rate on driver shots is suppressed. Therefore, the golf ball according to the present invention travels a greater distance on driver shots.

The golf ball according to the present invention travels a great distance on driver shots.

DESCRIPTION OF THE PREFERRED EMBODIMENT

Figure 1:
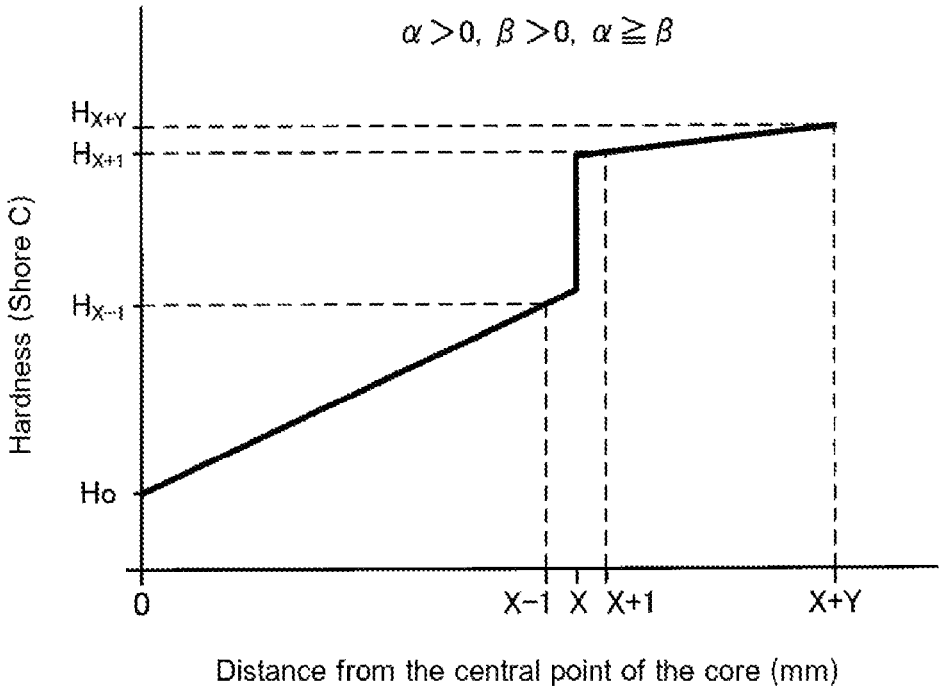
FIG. 1 is a drawing showing one example of a hardness distribution of a spherical core.
Figure 2:
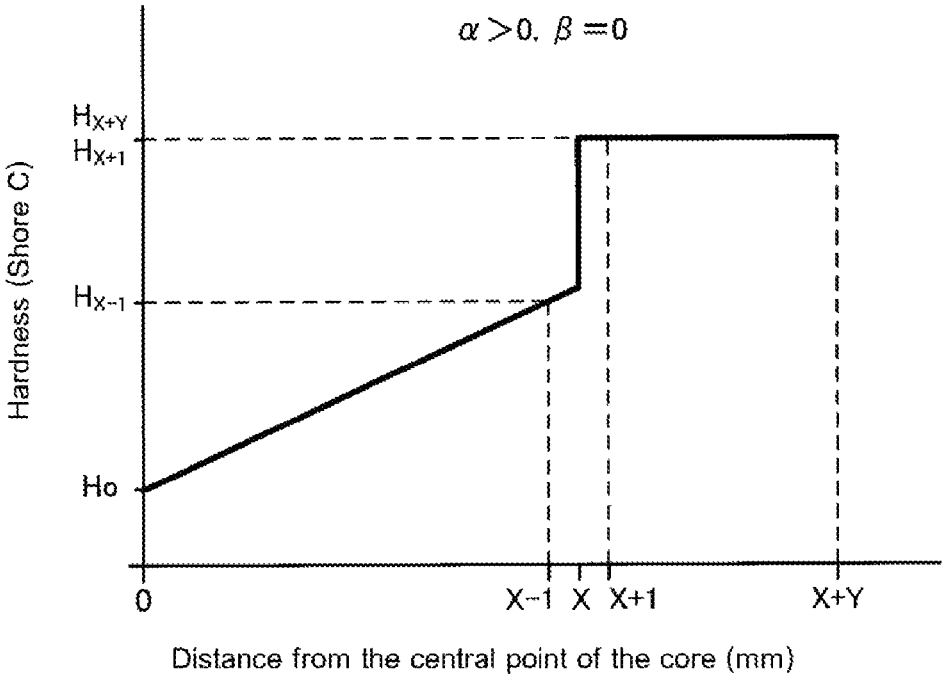
FIG. 2 is a drawing showing another example of a hardness distribution of a spherical core.
Figure 3:
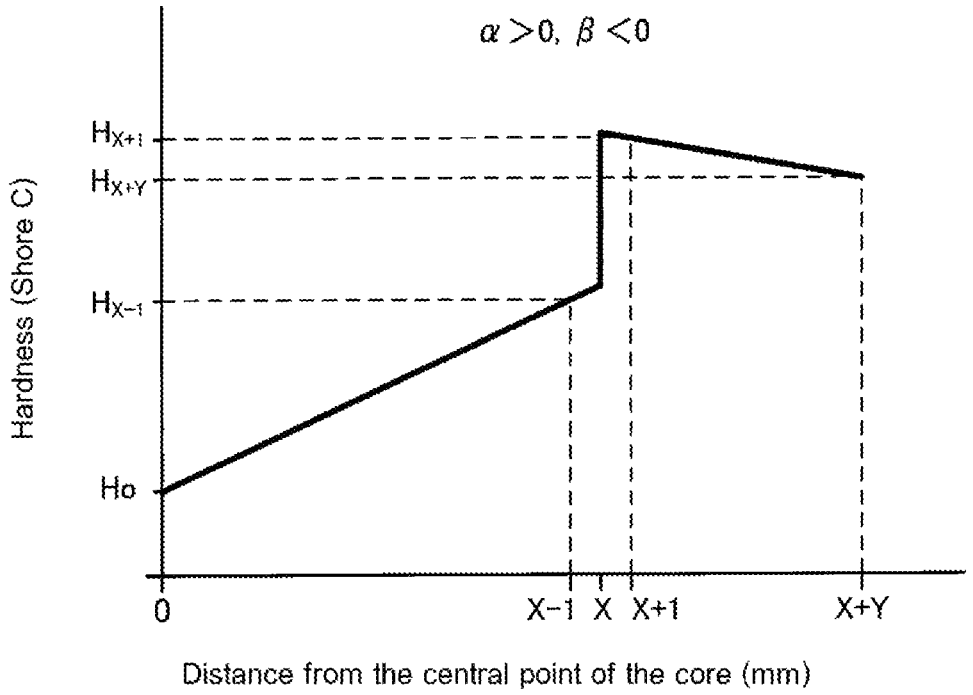
FIG. 3 is a drawing showing another example of a hardness distribution of a spherical core.
Figure 4:
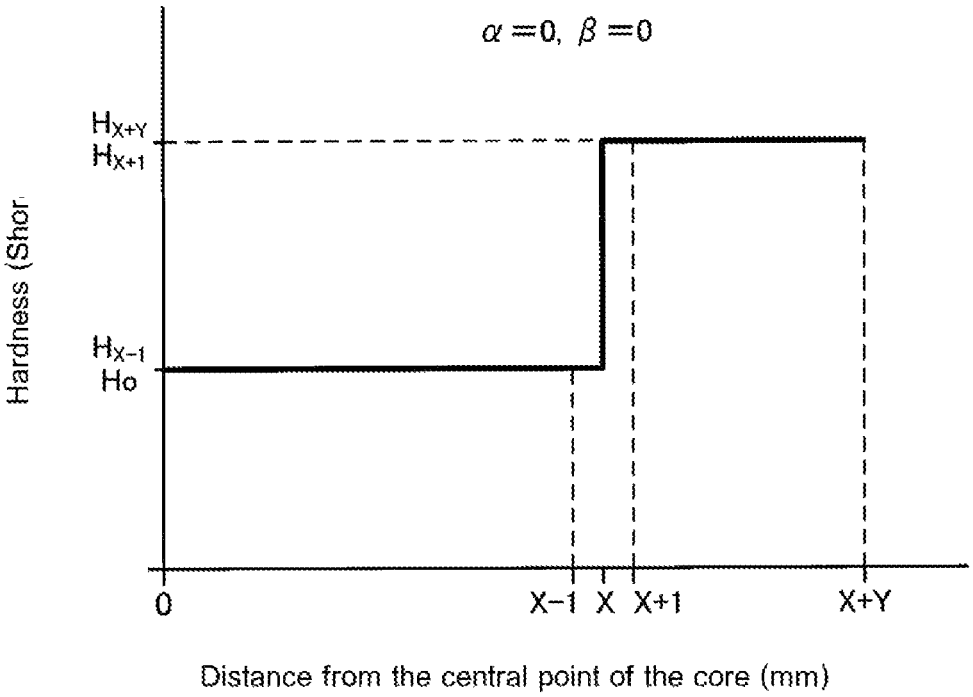
FIG. 4 is a drawing showing another example of a hardness distribution of a spherical core.

The golf ball according to the present invention comprises a spherical core, an intermediate layer positioned outside the spherical core, and a cover positioned outside the intermediate layer, and the spherical core includes an inner layer and an outer layer. Further, a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 70 in Shore C hardness, an angle $\alpha$ of a hardness gradient of the inner layer calculated by a formula (1) is 0° or more, a difference ($\alpha-\beta$) between the angle $\alpha$ and an angle $\beta$ of a hardness gradient of the outer layer calculated by a formula (2) is 0° or more, and the intermediate layer has a highest hardness among the constituent members of the golf ball, $$\alpha=(180/\pi)\times a\tan[\{H_{x-1}-Hoc\}/(X-1)] \quad (1)$$

$$\beta=(180/\pi)\times a\tan[\{H_{X+Y}-H_{x+1}\}/(Y-1)] \quad (2)$$

[where X represents a radius (mm) of the inner layer, Y represents a thickness (mm) of the outer layer, Hoc represents a center hardness (Shore C) of the spherical core, $H_{X-1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core].

With such a configuration, the ball initial velocity can be increased while suppressing the excessive spin rate on driver shots.

[Construction]

The spherical core includes a two-layered construction consisting of an inner layer and an outer layer. The spherical core is preferably formed from a rubber composition.

(Hardness Hoc)

The center hardness Hoc of the spherical core is a hardness (Shore C) measured at the central point of the cut plane obtained by cutting the spherical core into two hemispheres. The hardness Hoc is preferably 48 or more, more preferably 49 or more, and even more preferably 50 or more, and is preferably less than 70, more preferably 68 or less, and even more preferably 67 or less. If the hardness Hoc is 48 or more, the resilience performance is further enhanced, and if the hardness Hoc is less than 70, the excessive spin rate on driver shots is suppressed.

(Hardness Hod)

The center hardness Hod of the spherical core is a hardness (Shore D) measured at the central point of the cut plane obtained by cutting the spherical core into two hemispheres. The hardness Hod is preferably 32 or more, more preferably 33 or more, and even more preferably 34 or more, and is preferably less than 43, more preferably 42 or less, and even more preferably 41 or less. If the hardness Hod is 32 or more, the resilience performance is further enhanced, and if the hardness Hod is less than 43, the excessive spin rate on driver shots is suppressed.

(Hardness $H_{X-1}$)

The hardness $H_{X-1}$ is a hardness (Shore C) measured at the point inwardly away in the radial direction from the boundary between the inner layer and the outer layer by 1 mm on the cut plane obtained by cutting the spherical core into two hemispheres. In other words, the hardness $H_{X-1}$ is a hardness measured at a point having a distance of X−1 (mm) from the central point. The hardness $H_{X-1}$ is preferably 63 or more, more preferably 65 or more, and even more preferably 67 or more, and is preferably 82 or less, more preferably 80 or less, and even more preferably 78 or less. If the hardness $H_{X-1}$ is 63 or more, the resilience performance is enhanced, and if the hardness $H_{X-1}$ is 82 or less, the excessive spin rate on driver shots is suppressed.

(Hardness $H_{X+1}$)

The hardness $H_{X+1}$ is a hardness (Shore C) measured at the point outwardly away in the radial direction from the boundary between the inner layer and the outer layer by 1 mm on the cut plane obtained by cutting the spherical core into two hemispheres. In other words, the hardness $H_{X+1}$ is a hardness measured at a point having a distance of X+1 (mm) from the central point. The hardness $H_{X+1}$ is preferably 70 or more, more preferably 71 or more, and even more preferably 72 or more, and is preferably 90 or less, more preferably 88 or less, and even more preferably 86 or less. If the hardness $H_{X+1}$ is 70 or more, the resilience performance is enhanced, and if the hardness $H_{X+1}$ is 90 or less, the feeling becomes better.

(Hardness $H_{X+Y}$)

The hardness $H_{X+Y}$ is a hardness (Shore C) measured at the surface of the spherical core (outer core). The hardness $H_{X+Y}$ is preferably 70 or more, more preferably 71 or more, and even more preferably 72 or more, and is preferably 90 or less, more preferably 88 or less, and even more preferably 86 or less. If the hardness $H_{X+Y}$ is 70 or more, the resilience performance is enhanced, and if the hardness $H_{X+Y}$ is 90 or less, the feeling becomes better.

(Hardness Difference ($H_{X-1}$−Hoc))

The hardness difference ($H_{X-1}$−Hoc) between the center hardness Hoc and the hardness $H_{X-1}$, i.e. the hardness difference between the center hardness of the inner layer and the hardness of the inner layer near the boundary is preferably 4 or more, more preferably 5 or more, and even more preferably 6 or more, and is preferably 27 or less, more preferably 26 or less, and even more preferably 25 or less. If the hardness difference ($H_{X-1}$−Hoc) is 4 or more, the excessive spin rate on driver shots is suppressed, and if the hardness difference ($H_{X-1}$−Hoc) is 27 or less, the resilience performance is enhanced.

(Hardness Difference ($H_{X+1}$−$H_{X-1}$))

The hardness difference ($H_{X+1}$−$H_{X-1}$) between the hardness $H_{X-1}$ and the hardness $H_{X+1}$, i.e. the hardness difference between the inner layer hardness and the outer layer hardness near the boundary between the inner layer and the outer layer is preferably 0 or more, more preferably 5 or more, even more preferably 7 or more, and particularly preferably 8 or more, and is preferably 20 or less, more preferably 18 or less, and even more preferably 16 or less. If the hardness difference ($H_{X+1}$−$H_{X-1}$) is 0 or more, the excessive spin rate on driver shots is suppressed, and if the hardness difference ($H_{X+1}$−$H_{X-1}$) is 20 or less, the durability is enhanced.

(Hardness Difference ($H_{X+Y}$−$H_{X+1}$))

The hardness difference ($H_{X+Y}$−$H_{X+1}$) between the hardness $H_{X+1}$ and the surface hardness $H_{X+Y}$, i.e. the hardness difference between the outer layer hardness near the boundary and the surface hardness of the outer layer is preferably −7 or more, more preferably −6 or more, and even more preferably −5 or more, and is preferably 10 or less, more preferably 7 or less, and even more preferably 5 or less. If the hardness difference ($H_{X+Y}$−$H_{X+1}$) is −7 or more, the excessive spin rate on driver shots is suppressed, and if the hardness difference ($H_{X+Y}$−$H_{X+1}$) is 10 or less, the resilience performance is enhanced.

(Hardness Difference ($H_{X+Y}$−Hoc))

The hardness difference ($H_{X+Y}$−Hoc) between the center hardness Hoc and the surface hardness $H_{X+Y}$, i.e. the hardness difference between the center hardness and the surface hardness of the spherical core is preferably 14 or more, more preferably 16 or more, and even more preferably 18 or more, and is preferably 35 or less, more preferably 33 or less, and even more preferably 30 or less. If the hardness difference ($H_{X+Y}$−Hoc) is 14 or more, the excessive spin rate on driver shots is suppressed, and if the hardness difference ($H_{X+Y}$−Hoc) is 35 or less, the durability is enhanced.

(Angle α)

The angle α is calculated by a formula (1). The angle α (°) represents a hardness gradient of the inner layer. The angle α is preferably 0° or more, more preferably 15° or more, and even more preferably 20° or more, and is preferably 75° or less, more preferably 73° or less, and even more preferably 70° or less. If the angle α is 0° or more, the excessive spin rate on driver shots is suppressed, and if the angle α is 75° or less, the resilience performance is enhanced.

(Angle β)

The angle β is calculated by a formula (2). The angle β (°) represents a hardness gradient of the outer layer. The angle β is preferably −20° or more, more preferably −19° or more, and even more preferably −18° or more, and is preferably +20° or less, more preferably +19° or less, and even more preferably +18° or less. If the angle β is −20° or more, the excessive spin rate on driver shots is suppressed, and if the angle β is +20° or less, the resilience performance is enhanced.

(Angle Difference (α−β))

Figure 5:
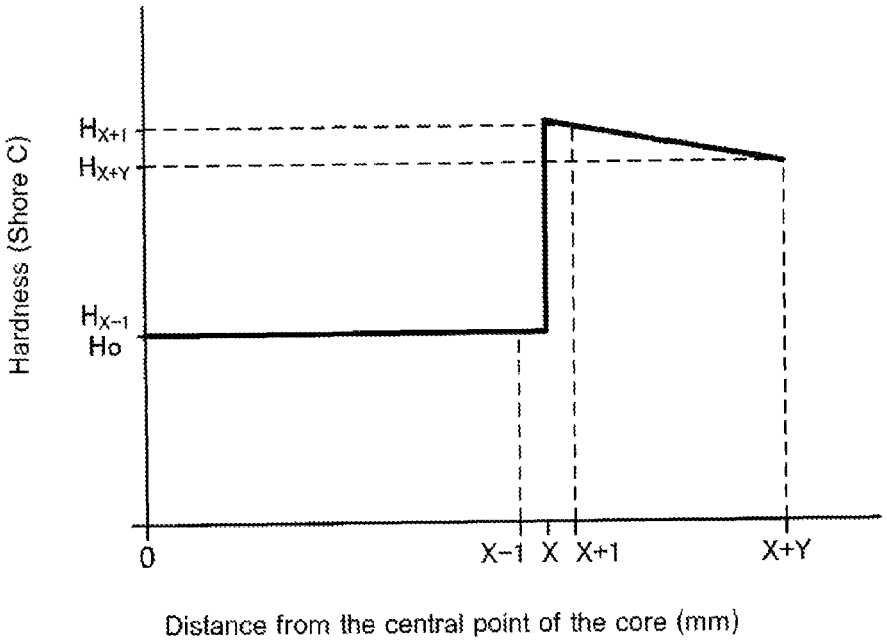
FIG. 5 is a drawing showing another example of a hardness distribution of a spherical core.

The difference (α−β) between the angle α and the angle β is 0° or more. Examples of the embodiment in which the difference (α−β) is 0° or more are shown in FIG. 1 to FIG. 5. FIG. 1 to FIG. 5 show examples of the hardness distribution of the spherical core. Examples of the embodiment in which the difference (α−β) is 0° or more include an embodiment in which the angle α and the angle β are positive, and the angle β is equal to or less than the angle α (FIG. 1); an embodiment in which the angle α is positive and the angle β is 0° (FIG. 2); an embodiment in which the angle α is positive and the angle β is negative (FIG. 3); an embodiment in which both the angle α and the angle β are 0° (FIG. 4); and an embodiment in which the angle α is 0° and the angle β is negative (FIG. 5). With such a configuration, the ball initial velocity can be increased while suppressing the excessive spin rate on driver shots.

The difference (α−β) is preferably 5 or more, more preferably 10 or more, and is preferably 85 or less, more preferably 80 or less, and even more preferably 75 or less. If the difference (α−β) is 85 or less, the resilience performance is enhanced.

(Radius X of Inner Layer)

The radius X is the radius (mm) of the inner layer of the core. The inner layer of the core preferably has a spherical shape. The radius X is preferably 7 mm or more, more preferably 9 mm or more, and even more preferably 10 mm or more, and is preferably 16 mm or less, more preferably 15 mm or less, and even more preferably 14 mm or less. If the radius X is 7 mm or more, the excessive spin rate on driver shots can be suppressed, and if the radius X is 16 mm or less, the resilience performance is enhanced.

(Thickness Y of Outer Layer)

The thickness Y is the thickness (mm) of the outer layer of the core. The thickness Y is preferably 3 mm or more, more preferably 4 mm or more, and even more preferably 5 mm or more, and is preferably 12 mm or less, more preferably 11 mm or less, and even more preferably 10 mm or less. If the thickness Y is 3 mm or more, the resilience performance becomes better, and if the thickness Y is 12 mm or less, the excessive spin rate on driver shots is suppressed.

(Ratio (Y/X))

The ratio (Y/X) of the thickness Y to the radius X is preferably 0.2 or more, more preferably 0.3 or more, and even more preferably 0.4 or more, and is preferably 2.0 or less, more preferably 1.7 or less, and even more preferably 1.5 or less. If the ratio (Y/X) is 0.2 or more, the resilience performance becomes better, and if the ratio (Y/X) is 2.0 or less, the excessive spin rate on driver shots is suppressed.

(Cross-Sectional Area S1)

The cross-sectional area S1 ($mm^2$) of the inner layer of the spherical core on the cut plane obtained by cutting the spherical core into two hemispheres is preferably 200 $mm^2$ or more, more preferably 250 $mm^2$ or more, and even more preferably 300 $mm^2$ or more, and is preferably 800 $mm^2$ or less, more preferably 700 $mm^2$ or less, and even more preferably 600 $mm^2$ or less. If the cross-sectional area S1 is 200 $mm^2$ or more, the resilience performance becomes better, and if the cross-sectional area S1 is 800 $mm^2$ or less, the excessive spin rate on driver shots is suppressed.

(Cross-Sectional Area S2)

The cross-sectional area S2 ($mm^2$) of the outer layer of the spherical core on the cut plane obtained by cutting the spherical core into two hemispheres is preferably 500 $mm^2$ or more, more preferably 550 $mm^2$ or more, and even more preferably 600 $mm^2$ or more, and is preferably 1000 $mm^2$ or less, more preferably 950 $mm^2$ or less, and even more preferably 900 $mm^2$ or less. If the cross-sectional area S2 is 500 $mm^2$ or more, the resilience performance becomes better, and if the cross-sectional area S2 is 1000 $mm^2$ or less, the excessive spin rate on driver shots is suppressed.

(Ratio (S2/S1))

The ratio (S2/S1) of the cross-sectional area S2 ($mm^2$) of the outer layer to the cross-sectional area S1 ($mm^2$) of the inner layer is preferably 0.5 or more, more preferably 0.6 or more, and even more preferably 0.7 or more, and is preferably 6.0 or less, more preferably 5.0 or less, and even more preferably 4.0 or less. If the ratio (S2/S1) is 0.5 or more, the resilience performance becomes better, and if the ratio (S2/S1) is 6.0 or less, the excessive spin rate on driver shots is suppressed.

(Volume V1)

The volume V1 ($mm^3$) of the inner layer of the spherical core is preferably 2000 $mm^3$ or more, more preferably 3000 $mm^3$ or more, and even more preferably 4000 $mm^3$ or more, and is preferably 17000 $mm^3$ or less, more preferably 14000 $mm^3$ or less, and even more preferably 12000 $mm^3$ or less. If the volume V1 is 2000 $mm^3$ or more, the resilience performance becomes better, and if the volume V1 is 17000 $mm^3$ or less, the excessive spin rate on driver shots is suppressed.

(Volume V2)

The volume V2 ($mm^3$) of the outer layer of the spherical core is preferably 15000 $mm^3$ or more, more preferably 16000 $mm^3$ or more, and even more preferably 17000 $mm^3$ or more, and is preferably 30000 $mm^3$ or less, more preferably 29000 $mm^3$ or less, and even more preferably 28000 $mm^3$ or less. If the volume V2 is 15000 $mm^3$ or more, the resilience performance becomes better, and if the volume V2 is 30000 $mm^3$ or less, the excessive spin rate on driver shots is suppressed.

(Ratio (V2/V1))

The ratio (V2/V1) of the volume V2 ($mm^3$) of the outer layer to the volume V1 ($mm^3$) of the inner layer is preferably 1.0 or more, more preferably 1.3 or more, and even more preferably 1.5 or more, and is preferably 20.0 or less, more preferably 15.0 or less, and even more preferably 12.0 or less. If the ratio (V2/V1) is 1.0 or more, the resilience performance becomes better, and if the ratio (V2/V1) is 20.0 or less, the excessive spin rate on driver shots is suppressed.

The diameter of the spherical core is preferably 36.5 mm or more, more preferably 37.0 mm or more, and even more preferably 37.5 mm or more, and preferably 42.0 mm or less, more preferably 41.0 mm or less, and even more preferably 40.2 mm or less. If the diameter of the spherical core is 36.5 mm or more, the spherical core is big and thus the resilience performance of the golf ball is further enhanced.

When the spherical core has a diameter ranging from 36.5 mm to 42.0 mm, the compression deformation amount of the core (shrinking amount of the core along the compression direction) when applying a load from 98 N as an initial load to 1275 N as a final load to the core is preferably 2.0 mm or more, more preferably 2.5 mm or more, and is preferably 4.8 mm or less, more preferably 4.5 mm or less. If the compression deformation amount is 2.0 mm or more, the shot feeling becomes better, and if the compression deformation amount is 4.8 mm or less, the resilience performance becomes better.

(Intermediate Layer)

The golf ball comprises an intermediate layer positioned outside the spherical core. The intermediate layer is disposed between the spherical core and the cover, and formed from a resin composition. The intermediate layer may comprise a single layer, or two or more layers. In the case that the intermediate layer comprises multiple layers, the material hardness (Hm) of the intermediate layer is a material hardness of a resin composition for forming an outermost intermediate layer, and the surface hardness of the intermediate layer is a surface hardness of the outermost intermediate layer.

The intermediate layer has a highest hardness among the constituent members of the golf ball. In other words, the material hardness Hm of the intermediate layer is highest among the center hardness Hoc of the spherical core, the hardness $H_{X+1}$ at the point outwardly away in the radial direction from the boundary between the inner layer and the outer layer of the spherical core by 1 mm, the hardness $H_{X-1}$ at the point inwardly away in the radial direction from the boundary between the inner layer and the outer layer of the spherical core by 1 mm, the surface hardness $H_{X+Y}$ of the spherical core, the material hardness Hm of the intermediate layer, and the material hardness Hc of the cover. If the material hardness Hm of the intermediate layer has a highest hardness, the excessive spin rate on driver shots can be suppressed, and thus the golf ball travels a greater distance.

The material hardness (Hm) of the intermediate layer is preferably 55 or more, more preferably 58 or more, and even more preferably 60 or more, and is preferably 77 or less, more preferably 75 or less, and even more preferably 73 or less in Shore D hardness. If the intermediate layer composition has a slab hardness of 55 or more, the excessive spin rate on driver shots can be suppressed, and if the intermediate layer has a material hardness of 77 or less, the soft shot feeling on approach shots is obtained.

The intermediate layer preferably has a thickness of 0.8 mm or more, more preferably 0.85 mm or more, and even more preferably 0.9 mm or more, and preferably has a thickness of 1.7 mm or less, more preferably 1.65 mm or less, and even more preferably 1.6 mm or less. If the intermediate layer has a thickness of 0.8 mm or more, the durability becomes better, and if the intermediate layer has a thickness of 1.7 mm or less, the resilience performance is enhanced. In the case that the intermediate layer comprises multiple layers, the thickness of each intermediate layer may be adjusted within the above range.

In the case that the intermediate layer comprises multiple layers, the total thickness of the intermediate layer is preferably 1.4 mm or more, more preferably 1.5 mm or more, and even more preferably 1.6 mm or more, and is preferably 2.3 mm or less, more preferably 2.2 mm or less, and even more preferably 2.1 mm or less. If the total thickness of the intermediate layer is 1.4 mm or more, the durability becomes better, and if the total thickness of the intermediate layer is 2.3 mm or less, the resilience performance is enhanced.

(Cover)

The golf ball comprises a cover positioned outside the intermediate layer. The cover constitutes the outermost layer of the golf ball body, and is formed from a resin composition.

The material hardness (Hc) of the resin composition for forming the cover is preferably 20 or more, more preferably 22 or more, and even more preferably 23 or more, and is preferably 49 or less, more preferably 48 or less, and more preferably 47 or less in shore D hardness. If the material hardness (Hc) is 20 or more in shore D hardness, the resilience of the cover is enhanced, and thus the flight distance on driver shots is increased. In addition, if the material hardness (Hc) is 49 or less in shore D hardness, the spin rate on approach shots is increased.

The cover preferably has a thickness of 0.2 mm or more, more preferably 0.3 mm or more, and even more preferably 0.4 mm or more, and preferably has a thickness of 0.9 mm or less, more preferably 0.85 mm or less, and even more preferably 0.8 mm or less. If the cover has a thickness of 0.2 mm or more, the spin performance on approach shots is enhanced, and if the cover has a thickness of 0.9 mm or less, the excessive spin rate on driver shots can be suppressed, and thus the golf ball travels a greater distance.

(Reinforcing Layer)

The golf ball may comprise a reinforcing layer between the intermediate layer and the cover. If the reinforcing layer is comprised, the adhesion between the intermediate layer and the cover is enhanced, and thus the durability of the golf ball becomes better. The reinforcing layer preferably has a thickness of 3 μm or more, more preferably 5 μm or more, and preferably has a thickness of 100 μm or less, more preferably 50 μm or less, and even more preferably 20 μm or less.

(Golf Ball)

The difference (Hm−Hod) between the material hardness (Hm) of the intermediate layer and the center hardness (Hod) of the spherical core is preferably 20 or more, more preferably 21 or more, and even more preferably 22 or more, and is preferably 40 or less, more preferably 38 or less, and even more preferably 36 or less in Shore D hardness. If the difference (Hm−Hod) is 20 or more in Shore D hardness, the excessive spin rate on driver shots can be suppressed, and thus the golf ball travels a greater distance. In addition, if the difference (Hm−Hod) is 40 or less in Shore D hardness, the resilience performance is enhanced.

The difference (Hm−Hc) between the material hardness (Hm) of the intermediate layer and the material hardness (Hc) of the cover is preferably 15 or more, more preferably 17 or more, and even more preferably 19 or more, and is preferably 40 or less, more preferably 39 or less, and even more preferably 38 or less in Shore D hardness. If the difference (Hm−Hc) is 15 or more in Shore D hardness, the excessive spin rate on driver shots can be suppressed, and thus the golf ball travels a greater distance. In addition, if the difference (Hm−Hc) is 40 or less in Shore D hardness, the spin rate on approach shots increases.

The Shore D hardness ratio ((Hm−Hod)/Hc) of the difference (Hm−Hod) between the material hardness (Hm) of the intermediate layer and the center hardness (Hod) of the spherical core to the material hardness (Hc) of the cover is preferably 0.6 or more, more preferably 0.65 or more, and even more preferably 0.7 or more, and is preferably 1.5 or less, more preferably 1.4 or less, and even more preferably 1.3 or less. If the Shore D hardness ratio ((Hm−Hod)/Hc) is 0.6 or more, the excessive spin rate on driver shots can be suppressed, and thus the golf ball travels a greater distance.

In addition, if the Shore D hardness ratio ((Hm−Hod)/Hc) is 1.5 or less, the spin rate on approach shots increases.

The difference (Hm−Hb) between the material hardness (Hm) of the intermediate layer and the surface hardness (Hb) of the golf ball is preferably 20 or more, more preferably 21 or more, and even more preferably 22 or more, and is preferably 35 or less, more preferably 34 or less, and even more preferably 33 or less in Shore D hardness. If the difference (Hm−Hb) is 20 or more in Shore D hardness, the excessive spin rate on driver shots can be suppressed, and thus the golf ball travels a greater distance. In addition, if the difference (Hm−Hb) is 35 or less in Shore D hardness, the resilience performance is enhanced.

The difference (Hb−Hc) between the surface hardness (Hb) of the golf ball and the material hardness (Hc) of the cover is preferably 20 or more, more preferably 21 or more, and even more preferably 22 or more, and is preferably 32 or less, more preferably 31 or less, and even more preferably 30 or less in Shore D hardness. If the difference (Hb−Hc) is 20 or more in Shore D hardness, the spin rate on approach shots increases. In addition, if the difference (Hb−Hc) is 32 or less in Shore D hardness, the excessive spin rate on driver shots can be suppressed, and thus the golf ball travels a greater distance.

The golf ball preferably has a diameter ranging from 40 mm to 45 mm. In light of satisfying the regulation of US Golf Association (USGA), the diameter is particularly preferably 42.67 mm or more. In light of prevention of the air resistance, the diameter is more preferably 44 mm or less, and particularly preferably 42.80 mm or less. In addition, the golf ball preferably has a mass of 40 g or more and 50 g or less. In light of obtaining greater inertia, the mass is more preferably 44 g or more, and particularly preferably 45.00 g or more. In light of satisfying the regulation of USGA, the mass is particularly preferably 45.93 g or less.

When the golf ball has a diameter ranging from 40 mm to 45 mm, the compression deformation amount of the golf ball (shrinking amount of the golf ball along the compression direction) when applying a load from 98 N as an initial load to 1275 N as a final load to the golf ball is preferably 1.5 mm or more, more preferably 1.6 mm or more, even more preferably 1.7 mm or more, and most preferably 1.8 mm or more, and is preferably 3.0 mm or less, more preferably 2.9 mm or less. If the compression deformation amount is 1.5 mm or more, the golf ball does not become excessively hard, and thus the shot feeling thereof is good. On the other hand, if the compression deformation amount is 3.0 mm or less, the resilience becomes high.

Examples of the golf ball according to the present invention include a four-piece golf ball comprising a two-layered spherical core, a single intermediate layer covering the spherical core, and a cover covering the intermediate layer; a five-piece golf ball comprising a two-layered spherical core, two intermediate layers covering the spherical core, and a cover covering the intermediate layers; and a golf ball having six pieces or more comprising a two-layered spherical core, three or more intermediate layers covering the spherical core, and a cover covering the intermediate layers. The present invention can be applied appropriately to any one of the above golf balls.

Figure 6:
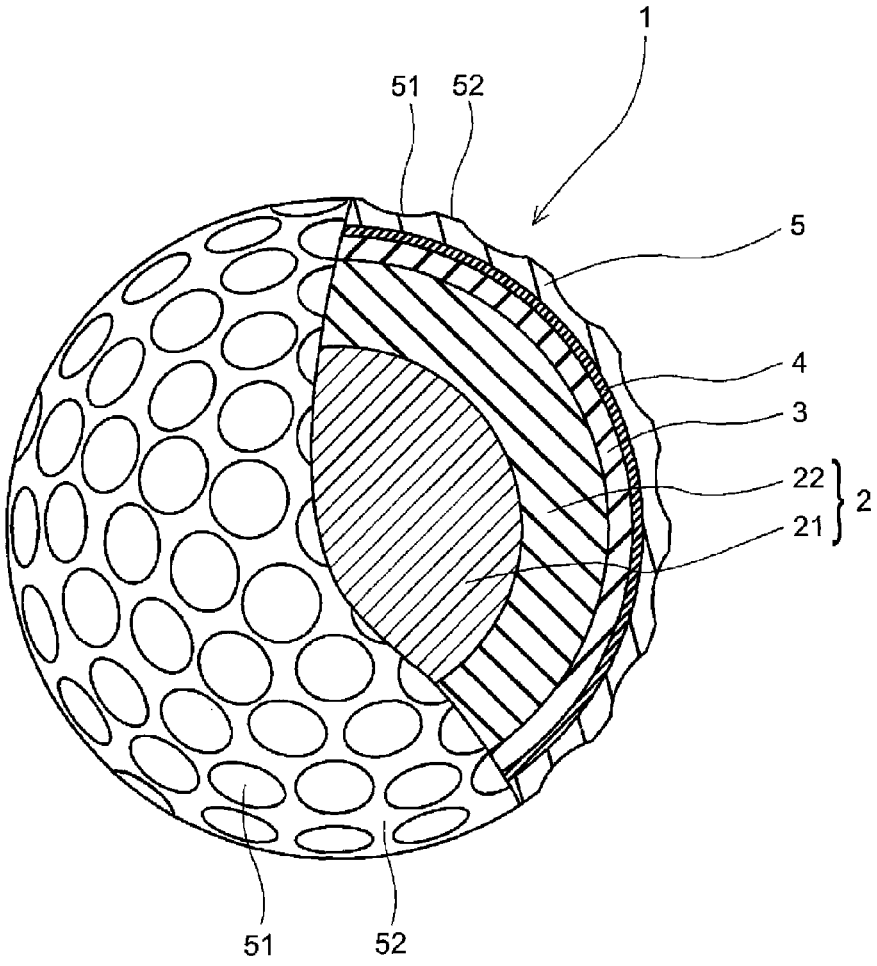
FIG. 6 is a partially cutaway sectional view showing a golf ball of one embodiment according to the present invention.

FIG. 6 is a partially cutaway sectional view showing a golf ball 1 according to one embodiment of the present invention. The golf ball 1 comprises a spherical core 2, an intermediate layer 3 positioned outside the spherical core 2, a reinforcing layer 4 positioned outside the intermediate layer 3, and a cover 5 positioned outside the reinforcing layer 4. The spherical core 2 comprises an inner layer 21 and an outer layer 22 positioned outside the inner layer 21. A plurality of dimples 51 are formed on the surface of the cover 5. Other portions than dimples 51 on the surface of the cover 5 are lands 52.

[Material]

The core, intermediate layer and cover of the golf ball may employ conventionally known materials.

The core may employ a conventionally known rubber composition (hereinafter, sometimes simply referred to as "core rubber composition"), and can be formed by, for example, heat-pressing a rubber composition containing a base rubber, a co-crosslinking agent, and a crosslinking initiator.

As the base rubber, typically preferred is a high cis-polybutadiene having cis-bond in a proportion of 40 mass % or more, more preferably 70 mass % or more, and even more preferably 90 mass % or more in view of its superior resilience property. The co-crosslinking agent is preferably an α,β-unsaturated carboxylic acid having 3 to 8 carbon atoms or a metal salt thereof, and more preferably a metal salt of acrylic acid or a metal salt of methacrylic acid. The metal constituting the metal salt is preferably zinc, magnesium, calcium, aluminum or sodium, more preferably zinc. The amount of the co-crosslinking agent is preferably 20 parts by mass or more and 50 parts by mass or less with respect to 100 parts by mass of the base rubber. When the α,β-unsaturated carboxylic acid having 3 to 8 carbon atoms is used as the co-crosslinking agent, a metal compound (e.g. magnesium oxide) is preferably used in combination. As the crosslinking initiator, an organic peroxide is preferably used. Specific examples of the organic peroxide include dicumyl peroxide, 1,1-bis(t-butylperoxy)-3,3,5-trimethylcyclohexane, 2,5-dimethyl-2,5-di(t-butylperoxy)hexane, and di-t-butyl peroxide. Among them, dicumyl peroxide is preferably used. The amount of the crosslinking initiator is preferably 0.2 part by mass or more, more preferably 0.3 part by mass or more, and is preferably 3 parts by mass or less, more preferably 2 parts by mass or less, with respect to 100 parts by mass of the base rubber.

Further, the core rubber composition may further contain an organic sulfur compound. As the organic sulfur compound, diphenyl disulfides (e.g. diphenyl disulfide, bis (pentabromophenyl) persulfide), thiophenols, and thionaphthols (e.g. 2-thionaphthol) are preferably used. The amount of the organic sulfur compound is preferably 0.1 part by mass or more, more preferably 0.3 part by mass or more, and is preferably 5.0 parts by mass or less, more preferably 3.0 parts by mass or less, with respect to 100 parts by mass of the base rubber. In addition, the core rubber composition may further contain a carboxylic acid and/or a salt thereof. As the carboxylic acid and/or the salt thereof, a carboxylic acid having 1 to 30 carbon atoms and/or a salt thereof is preferred. As the carboxylic acid, an aliphatic carboxylic acid or an aromatic carboxylic acid (such as benzoic acid) can be used. The amount of the carboxylic acid and/or the salt thereof is preferably 1 part by mass or more and 40 parts by mass or less with respect to 100 parts by mass of the base rubber.

The intermediate layer and the cover are formed from a resin composition. The resin composition includes a thermoplastic resin as a resin component. Examples of the thermoplastic resin include an ionomer resin, a thermoplastic olefin copolymer, a thermoplastic polyamide, a thermoplastic polyurethane, a thermoplastic styrene resin, a thermoplastic polyester, a thermoplastic acrylic resin, a thermoplastic polyolefin, a thermoplastic polydiene, and a thermoplastic polyether. Among the thermoplastic resin, a thermoplastic elastomer having rubber elasticity is preferred. Examples of the thermoplastic elastomer include a thermoplastic polyurethane elastomer, a thermoplastic polyamide elastomer, a thermoplastic styrene elastomer, a thermoplastic polyester elastomer, and a thermoplastic acrylic elastomer.

(Ionomer Resin)

Examples of the ionomer resin include an ionomer resin consisting of a metal ion-neutralized product of a binary copolymer composed of an olefin and an α,β-unsaturated carboxylic acid having 3 to 8 carbon atoms (hereinafter, sometimes referred to as "binary ionomer resin"); an ionomer resin consisting of a metal ion-neutralized product of a ternary copolymer composed of an olefin, an α,β-unsaturated carboxylic acid having 3 to 8 carbon atoms, and an α,β-unsaturated carboxylic acid ester (hereinafter, sometimes referred to as "ternary ionomer resin"); and a mixture of these ionomer resins.

The olefin is preferably an olefin having 2 to 8 carbon atoms, and examples thereof include ethylene, propylene, butene, pentene, hexene, heptene, and octene. Among them, ethylene is preferred. Examples of the α,β-unsaturated carboxylic acid having 3 to 8 carbon atoms include acrylic acid, methacrylic acid, fumaric acid, maleic acid and crotonic acid. Among them, acrylic acid and methacrylic acid are preferred.

As the α,β-unsaturated carboxylic acid ester, an alkyl ester of an α,β-unsaturated carboxylic acid having 3 to 8 carbon atoms is preferred, an alkyl ester of acrylic acid, methacrylic acid, fumaric acid or maleic acid is more preferred, and an alkyl ester of acrylic acid or an alkyl ester of methacrylic acid is particularly preferred. Examples of the alkyl group constituting the ester include methyl ester, ethyl ester, propyl ester, n-butyl ester, and isobutyl ester.

As the binary ionomer resin, a metal ion-neutralized product of an ethylene-(meth)acrylic acid binary copolymer is preferred. As the ternary ionomer resin, a metal ion-neutralized product of a ternary copolymer composed of ethylene, (meth)acrylic acid and (meth)acrylic acid ester is preferred. Herein, (meth)acrylic acid means acrylic acid and/or methacrylic acid.

Examples of the metal ion for neutralizing at least a part of carboxyl groups of the binary ionomer resin and/or the ternary ionomer resin include a monovalent metal ion such as sodium, potassium and lithium; a divalent metal ion such as magnesium, calcium, zinc, barium and cadmium; a trivalent metal ion such as aluminum; and other metal ion such as tin and zirconium. The binary ionomer resin and the ternary ionomer resin are preferably neutralized with at least one metal ion selected from the group consisting of $Na^+$, $Mg^{2+}$, $Ca^{2+}$ and $Zn^{2+}$.

Examples of the binary ionomer resin include Himilan (registered trademark) 1555 (Na), 1557 (Zn), 1605 (Na), 1706 (Zn), 1707 (Na), AM7311 (Mg), AM7329 (Zn) and AM7337 (commercially available from Du Pont-Mitsui Polychemicals Co., Ltd.); Surlyn (registered trademark) 8945 (Na), 9945 (Zn), 8140 (Na), 8150 (Na), 9120 (Zn), 9150 (Zn), 6910 (Mg), 6120 (Mg), 7930 (Li), 7940 (Li) and AD8546 (Li) (commercially available from E.I. du Pont de Nemours and Company); and Iotek (registered trademark) 8000 (Na), 8030 (Na), 7010 (Zn), 7030 (Zn) (commercially available from ExxonMobil Chemical Corporation).

Examples of the ternary ionomer resin include Himilan AM7327 (Zn), 1855 (Zn), 1856 (Na) and AM7331 (Na) (commercially available from Du Pont-Mitsui Polychemicals Co., Ltd.); Surlyn 6320 (Mg), 8120 (Na), 8320 (Na), 9320 (Zn), 9320W (Zn), HPF1000 (Mg) and HPF2000 (Mg) (commercially available from E.I. du Pont de Nemours and Company); and Iotek 7510 (Zn) and 7520 (Zn) (commercially available from ExxonMobil Chemical Corporation).

(Thermoplastic Olefin Copolymer)

Examples of the thermoplastic olefin copolymer include a binary copolymer composed of an olefin and an α,β-unsaturated carboxylic acid having 3 to 8 carbon atoms (hereinafter, sometimes referred to as "binary copolymer"); a ternary copolymer composed of an olefin, an α,β-unsaturated carboxylic acid having 3 to 8 carbon atoms and an α,β-unsaturated carboxylic acid ester (hereinafter, sometimes referred to as "ternary copolymer"); and a mixture of these copolymers. The thermoplastic olefin copolymer is a nonionic copolymer having carboxyl groups not being neutralized.

Examples of the olefin include those olefins used for constituting the ionomer resin. In particular, ethylene is preferred. Examples of the α,β-unsaturated carboxylic acid having 3 to 8 carbon atoms and the ester thereof include those α,β-unsaturated carboxylic acids having 3 to 8 carbon atoms and the esters thereof used for constituting the ionomer resin.

As the binary copolymer, a binary copolymer composed of ethylene and (meth)acrylic acid is preferred. As the ternary copolymer, a ternary copolymer composed of ethylene, (meth)acrylic acid and (meth)acrylic acid ester is preferred.

Examples of the binary copolymer include Nucrel (registered trademark) N1050H, N2050H, N1110H and N0200H (commercially available from Du Pont-Mitsui Polychemicals Co., Ltd.); and Primacor (registered trademark) 59801 (commercially available from Dow Chemical Company). Examples of the ternary copolymer include Nucrel AN4318 and AN4319 (commercially available from Du Pont-Mitsui Polychemicals Co., Ltd.); and Primacor AT310 and AT320 (commercially available from Dow Chemical Company).

(Thermoplastic Styrene Elastomer)

As the thermoplastic styrene elastomer, a thermoplastic elastomer containing a styrene block is preferably used. The thermoplastic elastomer containing a styrene block includes a polystyrene block that is a hard segment, and a soft segment. The typical soft segment is a diene block. Examples of the constituent component of the diene block include butadiene, isoprene, 1,3-pentadiene and 2,3-dimethyl-1,3-butadiene. Among them, butadiene and isoprene are preferred. Two or more constituent components may be used in combination.

Examples of the thermoplastic elastomer containing a styrene block include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS and a hydrogenated product of SIBS. Examples of the hydrogenated product of SBS include a styrene-ethylene-butylene-styrene block copolymer (SEBS). Examples of the hydrogenated product of SIS include a styrene-ethylene-propylene-styrene block copolymer (SEPS). Examples of the hydrogenated product of SIBS include a styrene-ethylene-ethylene-propylene-styrene block copolymer (SEEPS).

The content of the styrene component in the thermoplastic elastomer containing a styrene block is preferably 10 mass % or more, more preferably 12 mass % or more, and particularly preferably 15 mass % or more. In light of the shot feeling of the obtained golf ball, the content is preferably 50 mass % or less, more preferably 47 mass % or less, and particularly preferably 45 mass % or less.

Examples of the thermoplastic elastomer containing a styrene block include an alloy of one kind or two or more kinds selected from the group consisting of SBS, SIS, SIBS, SEBS, SEPS, SEEPS and the hydrogenated products thereof with a polyolefin. It is estimated that the olefin component in the alloy contributes to the improvement in compatibility with the ionomer resin. By using the alloy, the resilience performance of the golf ball becomes high. An olefin having 2 to 10 carbon atoms is preferably used. Appropriate examples of the olefin include ethylene, propylene, butane and pentene. Ethylene and propylene are particularly preferred.

Specific examples of the polymer alloy include Rabalon (registered trademark) T3221C, T3339C, SJ4400N, SJ5400N, SJ6400N, SJ7400N, SJ8400N, SJ9400N, and SR04 (commercially available from Mitsubishi Chemical Corporation). Examples of the thermoplastic elastomer containing a styrene block include Epofriend A1010 (commercially available from Daicel Chemical Industries, Ltd.), and Septon HG-252 (commercially available from Kuraray Co., Ltd.).

(Thermoplastic Polyurethane Elastomer)

The thermoplastic polyurethane elastomer has a urethane bond in its molecule. The urethane bond may be formed by a reaction between a polyol and a polyisocyanate. The polyol used as a raw material for forming the urethane bond has a plurality of hydroxyl groups. A low molecular weight polyol or a high molecular weight polyol may be used as the polyol.

Examples of the low molecular weight polyol include a diol, a triol, a tetraol, and a hexaol. Specific examples of the diol include ethylene glycol, diethylene glycol, triethylene glycol, 1,2-propanediol, 1,3-propanediol, 2-methyl-1,3-propanediol, dipropylene glycol, 1,2-butanediol, 1,3-butanediol, 1,4-butanediol, 2,3-butanediol, 2,3-dimethyl-2,3-butanediol, neopentyl glycol, pentanediol, hexanediol, heptanediol, octanediol, and 1,6-cyclohexanedimethylol. An aniline type diol or a bisphenol A type diol may be used as the diol. Specific examples of the triol include glycerin, trimethylolpropane and hexanetriol. Specific examples of the tetraol include pentaerythritol and sorbitol.

Examples of the high molecular weight polyol include a polyether polyol such as polyoxyethylene glycol (PEG), polyoxypropylene glycol (PPG) and polyoxytetramethylene glycol (PTMG); a condensed polyester polyol such as polyethylene adipate (PEA), polybutylene adipate (PBA) and polyhexamethylene adipate (PHMA); a lactone polyester polyol such as poly-ϵ-caprolactone (PCL); a polycarbonate polyol such as polyhexamethylene carbonate; and an acrylic polyol. Two or more kinds of the polyol may be used in combination. In light of the shot feeling of the golf ball, the high molecular weight polyol preferably has a number average molecular weight of 400 or more, more preferably 1000 or more, and preferably has a number average molecular weight of 10000 or less.

Examples of the polyisocyanate used as a raw material for forming the urethane bond include an aromatic diisocyanate, an alicyclic diisocyanate and an aliphatic diisocyanate. In addition, two or more kinds of the diisocyanate may be used in combination.

Examples of the aromatic diisocyanate include 2,4-toluene diisocyanate, 2,6-toluene diisocyanate, 4,4'-diphenylmethane diisocyanate (MDI), 1,5-naphthylene diisocyanate (NDI), 3,3'-bitolylene-4,4'-diisocyanate (TODD, xylylene diisocyanate (XDI), tetramethylxylylene diisocyanate (TMXDI), and para-phenylene diisocyanate (PPDI). Examples of the aliphatic diisocyanate include hexamethylene diisocyanate (HDI). Examples of the alicyclic diisocyanate include 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI). Among them, 4,4'-dicyclohexylmethane diisocyanate is preferred.

Specific examples of the thermoplastic polyurethane elastomer include Elastollan (registered trademark) NY84A10, XNY85A, XNY90A, XNY97A, ET885 and ET890 (commercially available from BASF Japan Ltd.).

The resin composition may further include an additive, for example, a pigment component such as a white pigment (e.g. titanium oxide) and a blue pigment, a weight adjusting agent, a dispersant, an antioxidant, an ultraviolet absorber, a light stabilizer, a fluorescent material or a fluorescent brightener. Examples of the weight adjusting agent include an inorganic filler such as zinc oxide, barium sulfate, calcium carbonate, magnesium oxide, tungsten powder, and molybdenum powder.

The content of the white pigment (e.g. titanium oxide) is preferably 0.05 part by mass or more, more preferably 1 part by mass or more, and is preferably 10 parts by mass or less, more preferably 8 parts by mass or less, with respect to 100 parts by mass of the thermoplastic resin. If the content of the white pigment is 0.05 part by mass or more, it is possible to impart the opacity to the obtained golf ball constituent member. If the content of the white pigment is more than 10 parts by mass, the durability of the obtained golf ball constituent member may deteriorate.

The resin composition can be obtained, for example, by dry blending the thermoplastic resin and the additive. Further, the dry blended mixture may be extruded into a pellet form. Dry blending is preferably carried out by using for example, a mixer capable of blending raw materials in a pellet form, more preferably carried out by using a tumbler type mixer. Extruding can be carried out by using a publicly known extruder such as a single-screw extruder, a twin-screw extruder, and a twin-single screw extruder.

The resin composition used for the intermediate layer preferably includes an ionomer resin as a resin component, particularly preferably includes a binary ionomer resin as the resin component. If the intermediate layer material includes the ionomer resin, the resilience of the intermediate layer is further enhanced, and thus the flight distance on driver shots becomes greater. The content of the ionomer resin in the resin component of the resin composition used for the intermediate layer is preferably 50 mass % or more, more preferably 65 mass % or more, and even more preferably 70 mass % or more.

It is preferred that the formulation of the resin composition used for the cover is appropriately set according to the desired performances of the golf ball. In case of a so-called spin golf ball focusing on controllability, the resin component preferably includes a polyurethane, and particularly preferably includes a thermoplastic polyurethane elastomer. If the cover material includes a polyurethane, the controllability on approach shots is enhanced. The content of the polyurethane in the resin component of the resin composition used for the cover is preferably 50 mass % or more, more preferably 70 mass % or more, and even more preferably 85 mass % or more.

The reinforcing layer is formed from a reinforcing layer composition containing a resin component. A two-component curing type thermosetting resin is preferably used as the resin component. Specific examples of the two-component curing type thermosetting resin include an epoxy resin, a urethane resin, an acrylic resin, a polyester resin, and a cellulose resin. In light of the strength and the durability of the reinforcing layer, the two-component curing type epoxy resin and the two-component curing type urethane resin are preferred.

The reinforcing layer composition may further include an additive such as a coloring material (e.g. titanium dioxide), a phosphoric acid stabilizer, an antioxidant, a light stabilizer, a fluorescent brightener, an ultraviolet absorber, and an anti-blocking agent. The additive may be added into the base agent or the curing agent of the two-component curing type thermosetting resin.

[Production Method]

The molding conditions for heat-pressing the core rubber composition should be determined appropriately depending on the formulation of the rubber composition. Generally, it is preferred that the molding is carried out by heating the core rubber composition at a temperature ranging from 130° C. to 200° C. for 10 minutes to 60 minutes, alternatively, by molding the core rubber composition in a two-step heating, i.e. at a temperature ranging from 130° C. to 150° C. for 20 minutes to 40 minutes, and then at a temperature ranging from 160° C. to 180° C. for 5 minutes to 15 minutes.

The method for molding the intermediate layer is not limited, and examples thereof include a method of molding the resin composition into semispherical half shells in advance, covering the core with two of the half shells, and performing compression molding; and a method of injection molding the resin composition directly onto the core to cover the core.

When injection molding the resin composition onto the core to mold the intermediate layer, it is preferred to use upper and lower molds having a semispherical cavity. Injection molding of the intermediate layer can be carried out by protruding the hold pin to hold the spherical body to be covered, charging the heated and melted resin composition, and then cooling to obtain the intermediate layer.

When molding the intermediate layer by the compression molding method, the half shell can be molded by either the compression molding method or the injection molding method, but the compression molding method is preferred. Compression molding the resin composition into half shells can be carried out, for example, under a pressure of 1 MPa or more and 20 MPa or less at a molding temperature of −20° C. or more and 70° C. or less relative to the flow beginning temperature of the resin composition. By carrying out the molding under the above conditions, the half shells with a uniform thickness can be formed. Examples of the method for molding the intermediate layer with half shells include a method of covering the spherical body with two of the half shells and then performing compression molding. Compression molding the half shells into the intermediate layer can be carried out, for example, under a molding pressure of 0.5 MPa or more and 25 MPa or less at a molding temperature of −20° C. or more and 70° C. or less relative to the flow beginning temperature of the resin composition. By carrying out the molding under the above conditions, the intermediate layer with a uniform thickness can be formed.

The embodiment for molding the resin composition into the cover is not particularly limited, and examples thereof include an embodiment of injection molding the resin composition directly onto the intermediate layer; and an embodiment of molding the resin composition into hollow shells, covering the intermediate layer with a plurality of the hollow shells, and performing compression molding (preferably an embodiment of molding the resin composition into hollow half shells, covering the intermediate layer with two of the half shells, and performing compression molding). The golf ball body having the cover formed thereon is ejected from the mold, and as necessary, is preferably subjected to surface treatments such as deburring, cleaning and sandblast. Further, if desired, a mark may be formed thereon.

The total number of the dimples formed on the cover is preferably 200 or more and 500 or less. If the total number of the dimples is less than 200, the dimple effect is hardly obtained. On the other hand, if the total number of the dimples exceeds 500, the dimple effect is hardly obtained because the size of the respective dimples is small. The shape (shape in a plan view) of the formed dimples includes, for example, without limitation, a circle; a polygonal shape such as a roughly triangular shape, a roughly quadrangular shape, a roughly pentagonal shape, and a roughly hexagonal shape; and other irregular shape. The shape of the dimples may be employed solely, or two or more of the shapes may be employed in combination.

The paint film preferably has a thickness of, but not particularly limited to, 5 μm or more, more preferably 7 μm or more, and preferably has a thickness of 50 μm or less, more preferably 40 μm or less, and even more preferably 30 μm or less. If the thickness of the paint film is less than 5 μm, the paint film is easy to wear off due to continued use of the golf ball, and if the thickness of the paint film is more than 50 μm, the dimple effect is reduced, and thus the flight performance of the golf ball may deteriorate.

EXAMPLES

Hereinafter, the present invention will be described in detail by way of examples. However, the present invention is not limited to the examples described below, and various changes and modifications can be made without departing from the spirit and scope of the present invention.

[Evaluation Method]

(1) Core Hardness Distribution (Shore C Hardness)

The Shore C hardness measured on the surface of the spherical core (outer layer core), with a type P1 auto loading durometer commercially available from Kobunshi Keiki Co., Ltd., provided with a Shore C type spring hardness tester, was adopted as the surface hardness of the outer layer core. In addition, the core was cut into two hemispheres to obtain a cut plane, and the hardness was measured at the central point of the cut plane and at the point having a predetermined distance from the central point of the cut plane. It is noted that the hardness at four points having the predetermined distance from the central point were measured, and the hardness was determined by averaging the hardness at four points.

(2) Center Hardness of Core (Shore D Hardness)

The hardness at the central point of the cut plane obtained by cutting the spherical core into two hemispheres, was measured with a type P1 auto loading durometer commercially available from Kobunshi Keiki Co., Ltd., provided with a Shore D type spring hardness tester.

(3) Slab Hardness (Shore D Hardness)

Sheets with a thickness of about 2 mm were produced by injection molding the golf ball resin composition. These sheets were stored at 23° C. for two weeks. Three or more of these sheets were stacked on one another so as not to be affected by the measuring substrate on which the sheets were placed, and the hardness of the stack was measured with a type P1 auto loading durometer commercially available from Kobunshi Keiki Co., Ltd., provided with a Shore D type spring hardness tester.

(4) Surface Hardness of Golf Ball (Shore D Hardness)

The hardness on the surface of the golf ball (i.e. on the surface of the paint layer) was measured with a type P1 auto loading durometer commercially available from Kobunshi Keiki Co., Ltd., provided with a Shore D type spring hardness tester.

(5) Compression Deformation Amount (mm)

The compression deformation amount of the golf ball or the spherical core along the compression direction (shrinking amount of the golf ball or the spherical core along the compression direction), when applying a load from 98 N as an initial load to 1275 N as a final load to the golf ball or the spherical core, was measured.

(6) Spin Rate, Ball Initial Velocity and Flight Distance on Driver Shots

A driver provided with a titanium head (trade name: "Z725", shaft hardness: X, loft angel: 8.5°, commercially available from Dunlop Sports Limited) was installed on a swing machine commercially available from True Temper Sports, Inc. The golf ball was hit at a head speed of 50 m/sec, and the ball initial velocity (m/s) and the spin rate (rpm) right after hitting the golf ball, and the flight distance (the distance (yd) from the launch point to the stop point) were measured. This measurement was conducted ten times for each golf ball, and the average value thereof was adopted as the measurement value for the golf ball. A sequence of photographs of the hit golf ball were taken for measuring the spin rate right after hitting the golf ball.

(7) Spin Rate on Approach Shots

A sand wedge (trade name: "588RTX CHROME WEDGE", shaft hardness: S, loft angel: 58°, commercially available from Cleveland Golf) was installed on a swing machine commercially available from Golf Laboratories, Inc. The golf ball was hit at a head speed of 10 m/sec, and the spin rate (rpm) right after hitting the golf ball, was measured. This measurement was conducted ten times for each golf ball, and the average value thereof was adopted as the measurement value for the golf ball. A sequence of photographs of the hit golf ball were taken for measuring the spin rate right after hitting the golf ball.

[Production of Golf Ball]

(1) Production of Spherical Core

Spherical Cores No. 1 to 6, 8 to 29, and 31 to 34

According to the formulations shown in Table 1, the materials were kneaded with a kneading roll to prepare the rubber compositions. The rubber compositions shown in Tables 2-4 were heat-pressed at 170° C. for 25 minutes in upper and lower molds having a semispherical cavity to produce the inner layer core. Then, the rubber compositions shown in Tables 2-4 were molded into half shells. Two of the half shells were used to cover the inner layer core. The inner layer core and the half shells were heat-pressed together at a temperature ranging from 140° C. to 170° C. for 25 minutes in upper and lower molds having a semispherical cavity to produce the spherical core. It is noted that the amount of barium sulfate in Table 1 was adjusted such that the density of the inner layer is identical to the density of the outer layer.

Spherical Cores No. 7 and 30

According to the formulation shown in Table 1, the materials were kneaded with a kneading roll to prepare the rubber composition. The rubber compositions shown in Tables 2-4 were heat-pressed at a temperature ranging from 150° C. to 170° C. for 25 minutes in upper and lower molds having a semispherical cavity to produce the single-layered cores. It is noted that the amount of barium sulfate in Table 1 was adjusted such that the golf ball has a mass in a range from 45.00 g to 45.92 g.

TABLE 1

| | | Rubber composition No. | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| Formulation (parts by mass) | Polybutadiene rubber | 100 | 100 | 100 | 100 | 100 | 100 | 100 | 100 | 100 | 100 | 100 | 100 | 100 |
| | Magnesium oxide | — | — | — | — | — | — | — | 34.8 | — | — | — | — | — |
| | Methacrylic acid | — | — | — | — | — | — | — | 28 | — | — | — | — | — |
| | Zinc acrylate | 20 | 25 | 44 | 38 | 46.5 | 25 | 32.5 | — | 35 | 35 | 26 | 28 | 13 |
| | Zinc oxide | 12 | 5 | 5 | 5 | 5 | 5 | 5 | — | 5 | 12 | 5 | 5 | 12 |
| | Barium sulfate | *) | *) | *) | *) | *) | *) | *) | — | *) | *) | *) | *) | *) |
| | Dicumyl peroxide | 0.9 | 0.7 | 0.7 | 0.7 | 0.7 | 0.7 | 0.9 | 0.9 | 0.9 | 0.9 | 0.7 | 0.7 | 0.9 |
| | PBDS | — | — | — | — | — | — | 0.3 | — | 0.3 | — | — | — | — |
| | DPDS | — | 0.5 | 0.5 | 0.5 | 0.5 | 0.5 | — | — | — | — | 0.5 | 0.5 | — |
| | 2-Thionaphtol | 0.1 | — | — | — | — | — | — | — | — | 0.1 | — | — | 0.1 |
| | Benzoic acid | 2 | — | — | — | — | — | — | — | — | 2 | — | — | 2 |
| | Antioxidant | — | — | 0.1 | — | 0.1 | 0.1 | — | — | — | — | 0.1 | 0.1 | — |

*) Appropriate amount

Polybutadiene rubber: "BR730 (cis-bond content: 96 mass %)" commercially available from JSR Corporation Magnesium oxide: "MAGSARAT (registered trademark) 150ST" commercially available from Kyowa Chemical Industry Co., Ltd.

Methacrylic acid: commercially available from Mitsubishi Rayon Co., Ltd.

Zinc acrylate: "Sanceler (registered trademark) SR" commercially available from Sanshin Chemical Industry Co., Ltd.

Zinc oxide: "Ginrei (registered trademark) R" commercially available from Toho Zinc Co., Ltd.

Barium sulfate: "Barium Sulfate BD" commercially available from Sakai Chemical Industry Co., Ltd.

Dicumyl peroxide: "Percumyl (registered trademark) D" commercially available from NOF Corporation PBDS (bis(pentabromophenyl) persulfide): commercially available from Kawaguchi Chemical Industry Co., Ltd.

DPDS (diphenyldisulfide): commercially available from Sumitomo Seika Chemicals Co., Ltd.

2-Thionaphtol: commercially available from Zhejiang shou & Fu Chemical Co., Ltd.

Benzoic acid: commercially available from Emerald Kalama Chemical Co., Ltd.

Antioxidant (dibutylhydroxytoluene): "H-BHT" commercially available from Honshu Chemical Industry Co. Ltd.

TABLE 2

| | | Spherical core No. | | | | |
|---|---|---|---|---|---|---|
| | | 1 | 2 | 3 | 4 | 5 |
| Inner layer | Rubber composition No. | 1 | 1 | 1 | 2 | 6 |
| | Radius X (mm) | 12.0 | 12.0 | 12.0 | 12.0 | 12.0 |
| | Cross-sectional area S1 ($mm^2$) | 452 | 452 | 452 | 452 | 452 |
| | Volume V1 ($mm^3$) | 7,238 | 7,238 | 7,238 | 7,238 | 7,238 |
| Outer layer | Rubber composition No. | 3 | 4 | 5 | 3 | 3 |
| | Thickness Y (mm) | 7.9 | 7.9 | 7.9 | 7.9 | 7.9 |
| | Cross-sectional area S2 ($mm^2$) | 785 | 785 | 785 | 785 | 785 |
| | Volume V2 ($mm^3$) | 25,524 | 25,524 | 25,524 | 25,524 | 25,524 |
| | Y/X | 0.65 | 0.65 | 0.65 | 0.65 | 0.65 |
| | S2/S1 | 1.74 | 1.74 | 1.74 | 1.74 | 1.74 |
| | V2/V1 | 3.53 | 3.53 | 3.53 | 3.53 | 3.53 |
| Hardness (Shore D) | Hod | 38.5 | 38.5 | 38.5 | 37.0 | 42.0 |
| Hardness (Shore C) | Hoc | 63 | 63 | 63 | 60 | 70 |
| | $H_{X-1}$ | 74 | 74 | 74 | 74 | 70 |
| | $H_{X+1}$ | 85 | 84 | 86 | 85 | 85 |
| | $H_{X+Y}$ | 85 | 86 | 84 | 85 | 85 |
| | $H_{X-1}$ − Hoc | 11 | 11 | 11 | 14 | 0 |
| | $H_{X+1}$ − $H_{X-1}$ | 11 | 10 | 12 | 11 | 15 |
| | $H_{X+Y}$ − $H_{X+1}$ | 0 | 2 | −2 | 0 | 0 |
| | $H_{X+Y}$ − Hoc | 22 | 23 | 21 | 25 | 15 |
| Angle (°) | α | 45.0 | 45.0 | 45.0 | 51.8 | 0.0 |
| | β | 0.0 | 16.3 | −16.3 | 0.0 | 0.0 |
| | α − β | 45.0 | 28.7 | 61.3 | 51.8 | 0.0 |
| Compression deformation amount (mm) | | 2.6 | 2.6 | 2.6 | 2.6 | 2.6 |

| | | Spherical core No. | | | | | |
|---|---|---|---|---|---|---|---|
| | | 6 | 7 | 8 | 9 | 10 | 11 |
| Inner layer | Rubber composition No. | 1 | 7 | 8 | 11 | 13 | 1 |
| | Radius X (mm) | 12.0 | 19.9 | 7.5 | 12.0 | 12.0 | 12.0 |
| | Cross-sectional area S1 ($mm^2$) | 452 | — | 177 | 452 | 452 | 452 |
| | Volume V1 ($mm^3$) | 7,238 | — | 1,767 | 7,238 | 7,238 | 7,238 |
| Outer layer | Rubber composition No. | 10 | — | 9 | 3 | 12 | 12 |
| | Thickness Y (mm) | 7.9 | — | 12.4 | 7.9 | 7.9 | 7.9 |
| | Cross-sectional area S2 ($mm^2$) | 785 | — | 1,061 | 785 | 785 | 785 |
| | Volume V2 ($mm^3$) | 25,524 | — | 30,995 | 25,524 | 25,524 | 25,524 |
| | Y/X | 0.65 | — | 1.65 | 0.65 | 0.65 | 0.65 |
| | S2/S1 | 1.74 | — | 6.00 | 1.74 | 1.74 | 1.74 |
| | V2/V1 | 3.53 | — | 17.54 | 3.53 | 3.53 | 3.53 |
| Hardness (Shore D) | Hod | 38.5 | 35.0 | 38.0 | 44.0 | 34.5 | 38.5 |
| Hardness (Shore C) | Hoc | 63 | 54 | 62 | 72 | 52 | 63 |
| | $H_{X-1}$ | 74 | — | 65 | 70 | 63 | 74 |
| | $H_{X+1}$ | 76 | — | 71 | 85 | 68 | 68 |
| | $H_{X+Y}$ | 85 | 80 | 85 | 85 | 68 | 68 |
| | $H_{X-1}$ − Hoc | 11 | — | 3 | −2 | 11 | 11 |
| | $H_{X+1}$ − $H_{X-1}$ | 2 | — | 6 | 15 | 5 | −6 |
| | $H_{X+Y}$ − $H_{X+1}$ | 9 | — | 14 | 0 | 0 | 0 |
| | $H_{X+Y}$ − Hoc | 22 | 26 | 23 | 13 | 16 | 5 |
| Angle (°) | α | 45.0 | — | 24.8 | −10.3 | 45.0 | 45.0 |
| | β | 52.7 | — | 51.0 | 0.0 | 0.0 | 0.0 |
| | α − β | −7.7 | — | −26.2 | −10.3 | 45.0 | 45.0 |
| Compression deformation amount (mm) | | 2.6 | 2.8 | 2.8 | 2.6 | 3.0 | 3.0 |

TABLE 3

| | | Spherical core No. | | | | | |
|---|---|---|---|---|---|---|---|
| | | 12 | 13 | 14 | 15 | 16 | 17 |
| Inner layer | Rubber composition No. | 1 | 1 | 1 | 1 | 1 | 1 |
| | Radius X (mm) | 12.0 | 12.0 | 12.0 | 12.0 | 12.0 | 12.0 |
| | Cross-sectional area S1 ($mm^2$) | 452 | 452 | 452 | 452 | 452 | 452 |
| | Volume V1 ($mm^3$) | 7,238 | 7,238 | 7,238 | 7,238 | 7,238 | 7,238 |
| Outer layer | Rubber composition No. | 3 | 3 | 3 | 3 | 3 | 3 |
| | Thickness Y (mm) | 8.1 | 7.8 | 7.6 | 7.4 | 7.7 | 7.3 |

TABLE 3-continued

| | | | | | | | |
|---|---|---|---|---|---|---|---|
| | Cross-sectional area S2 ($mm^2$) | 811 | 773 | 748 | 724 | 761 | 712 |
| | Volume V2 ($mm^3$) | 26,524 | 25,031 | 24,061 | 23,110 | 24,543 | 22,642 |
| | Y/X | 0.67 | 0.65 | 0.63 | 0.61 | 0.64 | 0.60 |
| | S2/S1 | 1.79 | 1.71 | 1.65 | 1.60 | 1.68 | 1.57 |
| | V2/V1 | 3.66 | 3.46 | 3.32 | 3.19 | 3.39 | 3.13 |
| Hardness (Shore D) | Hod | 38.5 | 38.5 | 38.5 | 38.5 | 38.5 | 38.5 |
| Hardness (Shore C) | Hoc | 63 | 63 | 63 | 63 | 63 | 63 |
| | $H_{X-1}$ | 74 | 74 | 74 | 74 | 74 | 74 |
| | $H_{X+1}$ | 85 | 85 | 85 | 85 | 85 | 85 |
| | $H_{X+Y}$ | 85 | 85 | 85 | 85 | 85 | 85 |
| | $H_{X-1}$ − Hoc | 11 | 11 | 11 | 11 | 11 | 11 |
| | $H_{X+1}$ − $H_{X-1}$ | 11 | 11 | 11 | 11 | 11 | 11 |
| | $H_{X+Y}$ − $H_{X+1}$ | 0 | 0 | 0 | 0 | 0 | 0 |
| | $H_{X+Y}$ − Hoc | 22 | 22 | 22 | 22 | 22 | 22 |
| Angle (°) | α | 45.0 | 45.0 | 45.0 | 45.0 | 45.0 | 45.0 |
| | β | 0.0 | 0.0 | 0.0 | 0.0 | 0.0 | 0.0 |
| | α − β | 45.0 | 45.0 | 45.0 | 45.0 | 45.0 | 45.0 |
| Compression deformation amount (mm) | | 2.6 | 2.6 | 2.6 | 2.6 | 2.6 | 2.6 |

| | | Spherical core No. | | | | | |
|---|---|---|---|---|---|---|---|
| | | 18 | 19 | 20 | 21 | 22 | 23 |
| Inner layer | Rubber composition No. | 1 | 1 | 1 | 1 | 1 | 1 |
| | Radius X (mm) | 12.0 | 12.0 | 12.0 | 12.0 | 12.0 | 12.0 |
| | Cross-sectional area S1 ($mm^2$) | 452 | 452 | 452 | 452 | 452 | 452 |
| | Volume V1 ($mm^3$) | 7,238 | 7,238 | 7,238 | 7,238 | 7,238 | 7,238 |
| Outer layer | Rubber composition No. | 3 | 3 | 3 | 3 | 3 | 3 |
| | Thickness Y (mm) | 7.9 | 7.9 | 7.9 | 7.9 | 7.3 | 7.3 |
| | Cross-sectional area S2 ($mm^2$) | 785 | 785 | 785 | 785 | 712 | 712 |
| | Volume V2 ($mm^3$) | 25,524 | 25,524 | 25,524 | 25,524 | 22,642 | 22,642 |
| | Y/X | 0.65 | 0.65 | 0.65 | 0.65 | 0.60 | 0.60 |
| | S2/S1 | 1.74 | 1.74 | 1.74 | 1.74 | 1.57 | 1.57 |
| | V2/V1 | 3.53 | 3.53 | 3.53 | 3.53 | 3.13 | 3.13 |
| Hardness (Shore D) | Hod | 38.5 | 38.5 | 38.5 | 38.5 | 38.5 | 38.5 |
| Hardness (Shore C) | Hoc | 63 | 63 | 63 | 63 | 63 | 63 |
| | $H_{X-1}$ | 74 | 74 | 74 | 74 | 74 | 74 |
| | $H_{X+1}$ | 85 | 85 | 85 | 85 | 85 | 85 |
| | $H_{X+Y}$ | 85 | 85 | 85 | 85 | 85 | 85 |
| | $H_{X-1}$ − Hoc | 11 | 11 | 11 | 11 | 11 | 11 |
| | $H_{X+1}$ − $H_{X-1}$ | 11 | 11 | 11 | 11 | 11 | 11 |
| | $H_{X+Y}$ − $H_{X+1}$ | 0 | 0 | 0 | 0 | 0 | 0 |
| | $H_{X+Y}$ − Hoc | 22 | 22 | 22 | 22 | 22 | 22 |
| Angle (°) | α | 45.0 | 45.0 | 45.0 | 45.0 | 45.0 | 45.0 |
| | β | 0.0 | 0.0 | 0.0 | 0.0 | 0.0 | 0.0 |
| | α − β | 45.0 | 45.0 | 45.0 | 45.0 | 45.0 | 45.0 |
| Compression deformation amount (mm) | | 2.6 | 2.6 | 2.6 | 2.6 | 2.6 | 2.6 |

TABLE 4

| | | Spherical core No. | | | | |
|---|---|---|---|---|---|---|
| | | 24 | 25 | 26 | 27 | 28 |
| Inner layer | Rubber composition No. | 1 | 1 | 1 | 2 | 6 |
| | Radius X (mm) | 12.0 | 12.0 | 12.0 | 12.0 | 12.0 |
| | Cross-sectional area S1 ($mm^2$) | 452 | 452 | 452 | 452 | 452 |
| | Volume V1 ($mm^3$) | 7,238 | 7,238 | 7,238 | 7,238 | 7,238 |
| Outer layer | Rubber composition No. | 3 | 4 | 5 | 3 | 3 |
| | Thickness Y (mm) | 7.3 | 7.3 | 7.3 | 7.3 | 7.3 |
| | Cross-sectional area S2 ($mm^2$) | 712 | 712 | 712 | 712 | 712 |
| | Volume V2 ($mm^3$) | 22,642 | 22,642 | 22,642 | 22,642 | 22,642 |
| | Y/X | 0.60 | 0.60 | 0.60 | 0.60 | 0.60 |
| | S2/S1 | 1.57 | 1.57 | 1.57 | 1.57 | 1.57 |
| | V2/V1 | 3.13 | 3.13 | 3.13 | 3.13 | 3.13 |
| Hardness (Shore D) | Hod | 38.5 | 38.5 | 38.5 | 37.0 | 42.0 |
| Hardness (Shore C) | Hoc | 63 | 63 | 63 | 60 | 70 |
| | $H_{X-1}$ | 74 | 74 | 74 | 74 | 70 |
| | $H_{X+1}$ | 85 | 84 | 86 | 85 | 85 |

TABLE 4-continued

| | | | | | | |
|---|---|---|---|---|---|---|
| | $H_{X+Y}$ | 85 | 86 | 84 | 85 | 85 |
| | $H_{X-1}$ − Hoc | 11 | 11 | 11 | 14 | 0 |
| | $H_{X+1}$ − $H_{X-1}$ | 11 | 10 | 12 | 11 | 15 |
| | $H_{X+Y}$ − $H_{X+1}$ | 0 | 2 | −2 | 0 | 0 |
| | $H_{X+Y}$ − Hoc | 22 | 23 | 21 | 25 | 15 |
| Angle (°) | α | 45.0 | 45.0 | 45.0 | 51.8 | 0.0 |
| | β | 0.0 | 17.7 | −17.7 | 0.0 | 0.0 |
| | α − β | 45.0 | 27.3 | 62.7 | 51.8 | 0.0 |
| Compression deformation amount (mm) | | 2.6 | 2.6 | 2.6 | 2.6 | 2.6 |

| | | Spherical core No. | | | | | |
|---|---|---|---|---|---|---|---|
| | | 29 | 30 | 31 | 32 | 33 | 34 |
| Inner layer | Rubber composition No. | 1 | 7 | 8 | 11 | 13 | 1 |
| | Radius X (mm) | 12.0 | 19.3 | 7.5 | 12.0 | 12.0 | 12.0 |
| | Cross-sectional area S1 ($mm^2$) | 452 | — | 177 | 452 | 452 | 452 |
| | Volume V1 ($mm^3$) | 7,238 | — | 1,767 | 7,238 | 7,238 | 7,238 |
| Outer layer | Rubber composition No. | 10 | — | 9 | 3 | 12 | 12 |
| | Thickness Y (mm) | 7.3 | — | 11.8 | 7.3 | 7.3 | 7.3 |
| | Cross-sectional area S2 ($mm^2$) | 712 | — | 987 | 712 | 712 | 712 |
| | Volume V2 ($mm^3$) | 22,642 | — | 28,113 | 22,642 | 22,642 | 22,642 |
| | Y/X | 0.60 | — | 1.57 | 0.60 | 0.60 | 0.60 |
| | S2/S1 | 1.57 | — | 5.59 | 1.57 | 1.57 | 1.57 |
| | V2/V1 | 3.13 | — | 15.91 | 3.13 | 3.13 | 3.13 |
| Hardness (Shore D) | Hod | 38.5 | 35.0 | 38.0 | 44.0 | 34.5 | 38.5 |
| Hardness (Shore C) | Hoc | 63 | 54 | 62 | 72 | 52 | 63 |
| | $H_{X-1}$ | 74 | — | 65 | 70 | 63 | 74 |
| | $H_{X+1}$ | 76 | — | 71 | 85 | 68 | 68 |
| | $H_{X+Y}$ | 85 | 80 | 85 | 85 | 68 | 68 |
| | $H_{X-1}$ − Hoc | 11 | — | 3 | −2 | 11 | 11 |
| | $H_{X+1}$ − $H_{X-1}$ | 2 | — | 6 | 15 | 5 | −6 |
| | $H_{X+Y}$ − $H_{X+1}$ | 9 | — | 14 | 0 | 0 | 0 |
| | $H_{X+Y}$ − Hoc | 22 | 26 | 23 | 13 | 16 | 5 |
| Angle (°) | α | 45.0 | — | 24.8 | −10.3 | 45.0 | 45.0 |
| | β | 55.2 | — | 52.5 | 0.0 | 0.0 | 0.0 |
| | α − β | −10.2 | — | −27.7 | −10.3 | 45.0 | 45.0 |
| Compression deformation amount (mm) | | 2.6 | 2.8 | 2.8 | 2.6 | 3.0 | 3.0 |

(2) Preparation of Resin Composition

According to the formulations shown in Table 5, the materials were mixed with a twin-screw kneading extruder to prepare the resin compositions in a pellet form. The extruding conditions were a screw diameter of 45 mm, a screw rotational speed of 200 rpm, and a screw L/D=35, and the mixture was heated to 160° C. to 230° C. at the die position of the extruder.

TABLE 5

| | | Resin composition No. | | | | | | |
|---|---|---|---|---|---|---|---|---|
| | | b | c | d | e | f | A | B |
| Formulation (parts by mass) | Himilan 1605 | 50 | 40 | — | — | — | — | — |
| | Himilan AM7329 | 50 | — | — | 41.5 | 35 | — | — |
| | Himilan AM7337 | — | — | — | 34.5 | 28 | — | — |
| | Himilan 1706 | — | 30 | — | — | — | — | — |
| | Himilan 1707 | — | 30 | — | — | — | — | — |
| | Rabalon T3221C | — | — | — | 14 | 21 | — | — |
| | Nucrel N1050H | — | — | — | 10 | 16 | — | — |
| | Surlyn 8150 | — | — | 50 | — | — | — | — |
| | Surlyn 9150 | — | — | 50 | — | — | — | — |
| | Elastollan NY84A10 | — | — | — | — | — | 100 | — |
| | Elastollan NY97A10 | — | — | — | — | — | — | 100 |
| | Elastollan wax master VD | — | — | — | — | — | 1.7 | 1.7 |
| | Titanium dioxide | 4 | 3 | 4 | 4 | 4 | 4 | 4 |

TABLE 5-continued

| | Resin composition No. | | | | | | |
|---|---|---|---|---|---|---|---|
| | b | c | d | e | f | A | B |
| Barium sulfate | *) | *) | *) | *) | *) | — | — |
| JF-90 | — | 0.2 | — | — | — | 0.2 | 0.2 |
| Slab hardness (Shore D) | 65 | 63 | 70 | 55 | 50 | 31 | 47 |

*) Appropriate amount

The materials used in Table 5 are as follows.

Himilan (registered trademark) 1605: sodium ion-neutralized ethylene-methacrylic acid copolymer ionomer resin commercially available from Du Pont-Mitsui Polychemicals Co., Ltd.
Himilan AM7329: zinc ion-neutralized ethylene-methacrylic acid copolymer ionomer resin commercially available from Du Pont-Mitsui Polychemicals Co., Ltd.
Himilan AM7337: sodium ion-neutralized ethylene-methacrylic acid copolymer ionomer resin commercially available from Du Pont-Mitsui Polychemicals Co., Ltd.
Himilan 1706: zinc ion-neutralized ethylene-methacrylic acid copolymer ionomer resin commercially available from Du Pont-Mitsui Polychemicals Co., Ltd.
Himilan 1707: sodium ion-neutralized ethylene-methacrylic acid copolymer ionomer resin commercially available from Du Pont-Mitsui Polychemicals Co., Ltd.
Rabalon (registered trademark) T3221C: thermoplastic styrene elastomer commercially available from Mitsubishi Chemical Corporation
Nucrel (registered trademark) N1050H: ethylene-methacrylic acid copolymer commercially available from Du Pont-Mitsui Polychemicals Co., Ltd.
Surlyn (registered trademark) 8150: sodium ion-neutralized ethylene-methacrylic acid copolymer ionomer resin commercially available from E. I. du Pont de Nemours and Company
Surlyn 9150: zinc ion-neutralized ethylene-methacrylic acid copolymer ionomer resin commercially available from E. I. du Pont de Nemours and Company
Elastollan (registered trademark) NY84A10: thermoplastic polyurethane elastomer commercially available from BASF Japan Ltd.
Elastollan (registered trademark) NY97A10: thermoplastic polyurethane elastomer commercially available from BASF Japan Ltd.
Elastollan wax master VD: release agent commercially available from BASF Japan Ltd.
Barium sulfate: "Barium Sulfate BD" commercially available from Sakai Chemical Industry Co., Ltd.
JF-90: light stabilizer commercially available from Johoku Chemical Co., Ltd.

(3) Production of Intermediate Layer

Golf Balls No. 1 to 21

The resin compositions shown in Tables 6 to 8 were injection molded on the core obtained above to form the intermediate layer. It is noted that the amount of barium sulfate in Table 5 was adjusted such that the slab hardness and the density became the desired values.

Golf Balls No. 24 to 34

The resin compositions shown in Tables 6 to 8 were injection molded on the core obtained above to form the inner intermediate layer. Then, the resin compositions shown in Tables 6 to 8 were injection molded on the inner intermediate layer to form the outer intermediate layer. It is noted that the amount of barium sulfate in Table 5 was adjusted such that the slab hardness and the density became the desired values.

(4) Production of Reinforcing Layer

Golf Balls No. 1 to 21 and 24 to 34

The reinforcing layer composition (trade name: "Polyn (registered trademark) 750LE" commercially available from Shinto Paint Co., Ltd.) including the two-component curing type epoxy resin as the base resin, was prepared. The base agent contained 30 parts by mass of the bisphenol A type solid epoxy resin and 70 parts by mass of the solvent. The curing agent contained 40 parts by mass of the modified polyamideamine, 5 parts by mass of titanium dioxide and 55 parts by mass of the solvent. The mass ratio of the base agent to the curing agent was 1/1. The reinforcing layer composition was applied on the surface of the intermediate layer with an air gun, and then kept in the atmosphere of 23° C. for 12 hours to form the reinforcing layer. The reinforcing layer had a thickness of 10 μm.

(5) Production of Cover

Golf Balls No. 1 to 21 and 24 to 34

The resin compositions shown in Tables 6 to 8 were charged one by one into each concave portion of the lower mold of the molds for molding half shells, and then compressed to form half shells. The intermediate layer-covered spherical body having the reinforcing layer formed thereon was concentrically covered with two of the half shells. The spherical body and the half shells were charged into the final mold provided with a plurality of pimples on the cavity surface thereof, and then compressed to form the cover. A plurality of dimples having a reversed shape of the pimple shape were formed on the cover.

Golf Balls No. 22 and 23

The resin compositions shown in Tables 6 to 8 were injection molded on the spherical core obtained above to form the cover. It is noted that the amount of barium sulfate in Table 5 was adjusted such that the slab hardness and the density became the desired values. A plurality of dimples were formed on the cover.

The surfaces of the obtained golf ball bodies were treated with sandblast and marked. Then, a clear paint including a two-component curing type polyurethane as a base material was applied on the surfaces of the golf ball bodies and dried in an oven to obtain the golf balls. The evaluation results of the obtained golf balls are shown in Tables 6 to 8.

TABLE 6

| | | | Golf ball No. | | | | | |
|---|---|---|---|---|---|---|---|---|
| | | | 1 | 2 | 3 | 4 | 5 | 6 |
| Spherical core | Spherical core No. | | 1 | 2 | 3 | 4 | 5 | 6 |
| | Hardness (Shore C) | $H_{X+Y}$ | 85 | 86 | 84 | 85 | 85 | 85 |
| | | $H_{X+1} - H_{X-1}$ | 11 | 10 | 12 | 11 | 15 | 2 |
| | Angle (°) | α | 45.0 | 45.0 | 45.0 | 51.8 | 0.0 | 45.0 |
| | | α − β | 45.0 | 28.7 | 61.3 | 51.8 | 0.0 | −7.7 |

TABLE 6-continued

| | | | | | | | | |
|---|---|---|---|---|---|---|---|---|
| Intermediate layer | Inner layer | Resin composition No. | b | b | b | b | b | b |
| | | Tm (mm) | 1.0 | 1.0 | 1.0 | 1.0 | 1.0 | 1.0 |
| | | Hm (Shore D) | 65.0 | 65.0 | 65.0 | 65.0 | 65.0 | 65.0 |
| | Outer layer | Resin composition No. | — | — | — | — | — | — |
| | | Tm (mm) | — | — | — | — | — | — |
| | | Hm (Shore D) | — | — | — | — | — | — |
| Cover | | Resin composition No. | A | A | A | A | A | A |
| | | Thickness Tc (mm) | 0.5 | 0.5 | 0.5 | 0.5 | 0.5 | 0.5 |
| | | Hc (Shore D) | 31.0 | 31.0 | 31.0 | 31.0 | 31.0 | 31.0 |
| Ball | | Hb (Shore D) | 64.0 | 64.0 | 64.0 | 64.0 | 64.0 | 64.0 |
| Hardness parameter | | Hm − Hc | 34.0 | 34.0 | 34.0 | 34.0 | 34.0 | 34.0 |
| | | Hm − Hb | 1.0 | 1.0 | 1.0 | 1.0 | 1.0 | 1.0 |
| | | Hb − Hc | 33.0 | 33.0 | 33.0 | 33.0 | 33.0 | 33.0 |
| | | (Hm − Hod)/Hc | 0.85 | 0.85 | 0.85 | 0.90 | 0.74 | 0.85 |
| | | Hm − Hod | 26.5 | 26.5 | 26.5 | 28.0 | 23.0 | 26.5 |
| Evaluation | Compression deformation amount (mm) | | 2.4 | 2.4 | 2.4 | 2.4 | 2.4 | 2.4 |
| | On driver shots | Spin rate (rpm) | 2,650 | 2,600 | 2,700 | 2,750 | 2,800 | 2,500 |
| | | Initial velocity (m/s) | 73.5 | 73.4 | 73.4 | 73.6 | 73.7 | 72.9 |
| | | Flight distance (yd) | 280 | 280 | 278 | 279 | 279 | 277 |
| | On approach shots | Spin rate (rpm) | 2,500 | 2,500 | 2,500 | 2,500 | 2,500 | 2,400 |

| | | | | Golf ball No. | | | | |
|---|---|---|---|---|---|---|---|---|
| | | | | 7 | 8 | 9 | 10 | 11 |
| Spherical core | Spherical core No. | | | 7 | 8 | 9 | 10 | 11 |
| | Hardness (Shore C) | | $H_{X+Y}$ | 80 | 85 | 85 | 68 | 68 |
| | | | $H_{X+1} - H_{X-1}$ | — | 6 | 15 | 5 | −6 |
| | Angle (°) | | α | — | 24.8 | −10.3 | 45.0 | 45.0 |
| | | | α − β | — | −26.2 | −10.3 | 45.0 | 45.0 |
| Intermediate layer | Inner layer | | Resin composition No. | b | b | b | b | b |
| | | | Tm (mm) | 1.0 | 1.0 | 1.0 | 1.0 | 1.0 |
| | | | Hm (Shore D) | 65.0 | 65.0 | 65.0 | 65.0 | 65.0 |
| | Outer layer | | Resin composition No. | — | — | — | — | — |
| | | | Tm (mm) | — | — | — | — | — |
| | | | Hm (Shore D) | — | — | — | — | — |
| Cover | | | Resin composition No. | A | A | A | A | A |
| | | | Thickness Tc (mm) | 0.5 | 0.5 | 0.5 | 0.5 | 0.5 |
| | | | Hc (Shore D) | 31.0 | 31.0 | 31.0 | 31.0 | 31.0 |
| Ball | | | Hb (Shore D) | 64.0 | 64.0 | 64.0 | 64.0 | 64.0 |
| Hardness parameter | | | Hm − Hc | 34.0 | 34.0 | 34.0 | 34.0 | 34.0 |
| | | | Hm − Hb | 1.0 | 1.0 | 1.0 | 1.0 | 1.0 |
| | | | Hb − Hc | 33.0 | 33.0 | 33.0 | 33.0 | 33.0 |
| | | | (Hm − Hod)/Hc | 0.97 | 0.87 | 0.68 | 0.98 | 0.85 |
| | | | Hm − Hod | 30.0 | 27.0 | 21.0 | 30.5 | 26.5 |
| Evaluation | Compression deformation amount (mm) | | | 2.4 | 2.4 | 2.4 | 2.9 | 2.9 |
| | On driver shots | | Spin rate (rpm) | 2,450 | 2,450 | 2,750 | 2,550 | 2,650 |
| | | | Initial velocity (m/s) | 72.7 | 72.8 | 73.4 | 72.8 | 72.9 |
| | | | Flight distance (yd) | 276 | 277 | 277 | 275 | 276 |
| | On approach shots | | Spin rate (rpm) | 2,500 | 2,300 | 2,500 | 2,550 | 2,600 |

TABLE 7

| | | | Golf ball No. | | | | | |
|---|---|---|---|---|---|---|---|---|
| | | | 12 | 13 | 14 | 15 | 16 | 17 |
| Spherical core | Spherical core No. | | 12 | 13 | 14 | 15 | 16 | 17 |
| | Hardness (Shore C) | $H_{X-Y}$ | 85 | 85 | 85 | 85 | 85 | 85 |
| | | $H_{X+1} - H_{X-1}$ | 11 | 11 | 11 | 11 | 11 | 11 |
| | Angle (°) | α | 45.0 | 45.0 | 45.0 | 45.0 | 45.0 | 45.0 |
| | | α − β | 45.0 | 45.0 | 45.0 | 45.0 | 45.0 | 45.0 |
| Intermediate layer | Inner layer | Resin composition No. | b | b | b | b | b | b |
| | | Tm (mm) | 1.0 | 1.0 | 1.0 | 1.0 | 1.2 | 1.6 |
| | | Hm (Shore D) | 65.0 | 65.0 | 65.0 | 65.0 | 65.0 | 65.0 |
| | Outer layer | Resin composition No. | — | — | — | — | — | — |
| | | Tm (mm) | — | — | — | — | — | — |
| | | Hm (Shore D) | — | — | — | — | — | — |
| Cover | | Resin composition No. | A | A | A | A | A | A |
| | | Thickness Tc (mm) | 0.3 | 0.6 | 0.8 | 1.0 | 0.5 | 0.5 |
| | | Hc (Shore D) | 31.0 | 31.0 | 31.0 | 31.0 | 31.0 | 31.0 |
| Ball | | Hb (Shore D) | 64.5 | 63.0 | 58.0 | 56.0 | 64.0 | 64.0 |

TABLE 7-continued

| | | | | | | | | |
|---|---|---|---|---|---|---|---|---|
| Hardness parameter | | Hm − Hc | 34.0 | 34.0 | 34.0 | 34.0 | 34.0 | 34.0 |
| | | Hm − Hb | 0.5 | 2.0 | 7.0 | 9.0 | 1.0 | 1.0 |
| | | Hb − Hc | 33.5 | 32.0 | 27.0 | 25.0 | 33.0 | 33.0 |
| | | (Hm − Hod)/Hc | 0.85 | 0.85 | 0.85 | 0.85 | 0.85 | 0.85 |
| | | Hm − Hod | 26.5 | 26.5 | 26.5 | 26.5 | 26.5 | 26.5 |
| Evaluation | Compression deformation amount (mm) | | 2.4 | 2.4 | 2.5 | 2.6 | 2.3 | 2.2 |
| | On driver shots | Spin rate (rpm) | 2,550 | 2,700 | 2,700 | 2,850 | 2,650 | 2,650 |
| | | Initial velocity (m/s) | 73.6 | 73.5 | 73.4 | 73.4 | 73.5 | 73.4 |
| | | Flight distance (yd) | 283 | 279 | 278 | 273 | 280 | 279 |
| | On approach shots | Spin rate (rpm) | 2,400 | 2,600 | 2,750 | 2,900 | 2,500 | 2,500 |

| | | | Golf ball No. | | | | | |
|---|---|---|---|---|---|---|---|---|
| | | | 18 | 19 | 20 | 21 | 22 | 23 |
| Spherical core | Spherical core No. | | 18 | 19 | 20 | 21 | 22 | 23 |
| | Hardness (Shore C) | $H_{X-Y}$ | 85 | 85 | 85 | 85 | 85 | 85 |
| | | $H_{X+1} - H_{X-1}$ | 11 | 11 | 11 | 11 | 11 | 11 |
| | Angle (°) | α | 45.0 | 45.0 | 45.0 | 45.0 | 45.0 | 45.0 |
| | | α − β | 45.0 | 45.0 | 45.0 | 45.0 | 45.0 | 45.0 |
| Intermediate layer | Inner layer | Resin composition No. | c | d | b | b | — | — |
| | | Tm (mm) | 1.0 | 1.0 | 1.0 | 1.0 | — | — |
| | | Hm (Shore D) | 63.0 | 70.0 | 65.0 | 65.0 | — | — |
| | Outer layer | Resin composition No. | — | — | — | — | — | — |
| | | Tm (mm) | — | — | — | — | — | — |
| | | Hm (Shore D) | — | — | — | — | — | — |
| | Cover | Resin composition No. | A | A | B | f | c | A |
| | | Thickness Tc (mm) | 0.5 | 0.5 | 0.5 | 0.5 | 2.1 | 2.1 |
| | | Hc (Shore D) | 31.0 | 31.0 | 47.0 | 50.0 | 63.0 | 31.0 |
| | Ball | Hb (Shore D) | 62.5 | 68.5 | 64.0 | 64.0 | 63.0 | 68.5 |
| Hardness parameter | | Hm − Hc | 32.0 | 39.0 | 18.0 | 15.0 | — | — |
| | | Hm − Hb | 0.5 | 1.5 | 1.0 | 1.0 | — | — |
| | | Hb − Hc | 31.5 | 37.5 | 17.0 | 14.0 | 0.0 | 37.5 |
| | | (Hm − Hod)/Hc | 0.79 | 1.02 | 0.56 | 0.53 | — | — |
| | | Hm − Hod | 24.5 | 31.5 | 26.5 | 26.5 | — | — |
| Evaluation | Compression deformation amount (mm) | | 2.5 | 2.3 | 2.4 | 2.1 | 2.1 | 2.4 |
| | On driver shots | Spin rate (rpm) | 2,700 | 2,550 | 2,600 | 2,550 | 2,400 | 3,000 |
| | | Initial velocity (m/s) | 73.6 | 73.6 | 73.5 | 73.6 | 73.8 | 73.2 |
| | | Flight distance (yd) | 279 | 283 | 281 | 283 | 288 | 270 |
| | On approach shots | Spin rate (rpm) | 2,550 | 2,450 | 2,350 | 2,250 | 2,200 | 3,000 |

TABLE 8

| | | | Golf ball No. | | | | | |
|---|---|---|---|---|---|---|---|---|
| | | | 24 | 25 | 26 | 27 | 28 | 29 |
| Spherical core | Spherical core No. | | 24 | 25 | 26 | 27 | 28 | 29 |
| | Hardness (Shore C) | $H_{X+Y}$ | 85 | 86 | 84 | 85 | 85 | 85 |
| | | $H_{X+1} - H_{X-1}$ | 11 | 10 | 12 | 11 | 15 | 2 |
| | Angle (°) | α | 45.0 | 45.0 | 45.0 | 51.8 | 0.0 | 45.0 |
| | | α − β | 45.0 | 27.3 | 62.7 | 51.8 | 0.0 | −10.2 |
| Intermediate layer | Inner layer | Resin composition No. | d | d | d | d | d | d |
| | | Tm (mm) | 1.0 | 1.0 | 1.0 | 1.0 | 1.0 | 1.0 |
| | | Hm (Shore D) | 70.0 | 70.0 | 70.0 | 70.0 | 70.0 | 70.0 |
| | Outer layer | Resin composition No. | e | e | e | e | e | e |
| | | Tm (mm) | 0.8 | 0.8 | 0.8 | 0.8 | 0.8 | 0.8 |
| | | Hm (Shore D) | 55.0 | 55.0 | 55.0 | 55.0 | 55.0 | 55.0 |
| | Cover | Resin composition No. | A | A | A | A | A | A |
| | | Thickness Tc (mm) | 0.3 | 0.3 | 0.3 | 0.3 | 0.3 | 0.3 |
| | | Hc (Shore D) | 31.0 | 31.0 | 31.0 | 31.0 | 31.0 | 31.0 |
| | Ball | Hb (Shore D) | 53.0 | 53.0 | 53.0 | 53.0 | 53.0 | 53.0 |
| Hardness parameter | | Hm − Hc | 24.0 | 24.0 | 24.0 | 24.0 | 24.0 | 24.0 |
| | | Hm − Hb | 2.0 | 2.0 | 2.0 | 2.0 | 2.0 | 2.0 |
| | | Hb − Hc | 22.0 | 22.0 | 22.0 | 22.0 | 22.0 | 22.0 |
| | | (Hm − Hod)/Hc | 0.53 | 0.53 | 0.53 | 0.58 | 0.42 | 0.53 |
| | | Hm − Hod | 16.5 | 16.5 | 16.5 | 18.0 | 13.0 | 16.5 |
| Evaluation | Compression deformation amount (mm) | | 2.1 | 2.1 | 2.1 | 2.1 | 2.1 | 2.1 |
| | On driver shots | Spin rate (rpm) | 2,600 | 2,550 | 2,650 | 2,700 | 2,750 | 2,450 |
| | | Initial velocity (m/s) | 73.6 | 73.5 | 73.5 | 73.7 | 73.8 | 73.0 |
| | | Flight distance (yd) | 282 | 282 | 280 | 281 | 281 | 279 |

TABLE 8-continued

| | | | | | | | |
|---|---|---|---|---|---|---|---|
| On approach shots | Spin rate (rpm) | | 2,400 | 2,400 | 2,400 | 2,400 | 2,300 |

| | | | Golf ball No. | | | | |
|---|---|---|---|---|---|---|---|
| | | | 30 | 31 | 32 | 33 | 34 |
| Spherical core | Spherical core No. | | 30 | 31 | 32 | 33 | 34 |
| | Hardness (Shore C) | $H_{X+Y}$ | 80 | 85 | 85 | 68 | 68 |
| | | $H_{X+1} - H_{X-1}$ | — | 6 | 15 | 5 | −6 |
| | Angle (°) | α | — | 24.8 | −10.3 | 45.0 | 45.0 |
| | | α − β | — | −27.7 | −10.3 | 45.0 | 45.0 |
| Intermediate layer | Inner layer | Resin composition No. | d | d | d | d | d |
| | | Tm (mm) | 1.0 | 1.0 | 1.0 | 1.0 | 1.0 |
| | | Hm (Shore D) | 70.0 | 70.0 | 70.0 | 70.0 | 70.0 |
| | Outer layer | Resin composition No. | e | e | e | e | e |
| | | Tm (mm) | 0.8 | 0.8 | 0.8 | 0.8 | 0.8 |
| | | Hm (Shore D) | 55.0 | 55.0 | 55.0 | 55.0 | 55.0 |
| | Cover | Resin composition No. | A | A | A | A | A |
| | | Thickness Tc (mm) | 0.3 | 0.3 | 0.3 | 0.3 | 0.3 |
| | | Hc (Shore D) | 31.0 | 31.0 | 31.0 | 31.0 | 31.0 |
| | Ball | Hb (Shore D) | 53.0 | 53.0 | 53.0 | 53.0 | 53.0 |
| | Hardness parameter | Hm − Hc | 24.0 | 24.0 | 24.0 | 24.0 | 24.0 |
| | | Hm − Hb | 2.0 | 2.0 | 2.0 | 2.0 | 2.0 |
| | | Hb − Hc | 22.0 | 22.0 | 22.0 | 22.0 | 22.0 |
| | | (Hm − Hod)/Hc | 0.65 | 0.55 | 0.35 | 0.66 | 0.53 |
| | | Hm − Hod | 20.0 | 17.0 | 11.0 | 20.5 | 16.5 |
| Evaluation | Compression deformation amount (mm) | | 2.1 | 2.1 | 2.1 | 2.5 | 2.5 |
| | On driver shots | Spin rate (rpm) | 2,400 | 2,400 | 2,700 | 2,500 | 2,600 |
| | | Initial velocity (m/s) | 72.8 | 72.9 | 73.5 | 72.9 | 73.0 |
| | | Flight distance (yd) | 278 | 279 | 279 | 277 | 278 |
| | On approach shots | Spin rate (rpm) | 2,400 | 2,200 | 2,400 | 2,450 | 2,500 |

Golf balls No. 1 to 11 having the same formulation and thickness in the intermediate layer and in the cover, are compared. Golf balls No. 6, 8 and 9 are the cases where the difference (α−β) between the angle α of the hardness gradient of the inner layer and the angle β of the hardness gradient of the outer layer is less than 0°. Golf ball No. 7 is the case where the spherical core is single-layered. Golf ball No. 9 is the case where the angle α of the hardness gradient of the inner layer is less than 0°. Golf balls No. 10 and 11 are the cases where the surface hardness ($H_{X+Y}$) is 70 or less in Shore C hardness. Golf ball No. 11 is the case where the difference ($H_{x+1}$−$H_{x-1}$) is less than 0 in Shore C hardness. These golf balls show a small spin decrease effect or a small initial velocity on driver shots, thus the flight distance thereof is not improved.

Golf balls No. 24 to 34 having the same formulation and thickness in the intermediate layer and in the cover, are compared. Golf balls No. 29, 31 and 32 are the cases where the difference (α−β) between the angle α of the hardness gradient of the inner layer and the angle β of the hardness gradient of the outer layer is less than 0°. Golf ball No. 30 is the case where the spherical core is single-layered. Golf ball No. 32 is the case where the angle α of the hardness gradient of the inner layer is less than 0°. Golf balls No. 33 and 34 are the cases where the surface hardness ($H_{X+Y}$) is 70 or less in Shore C hardness. Golf ball No. 34 is the case where the difference ($H_{x+1}$−$H_{x-1}$) is less than 0 in Shore C hardness. These golf balls show a small spin decrease effect or a small initial velocity on driver shots, thus the flight distance thereof is not improved.

In addition, Golf balls No. 12 to 23 comprising the same spherical core are compared. Golf ball No. 15 is the case where the difference (Hm−Hb) is 9 or more. Golf balls No. 22 and 23 are the cases where no intermediate layer is comprised. Golf ball No. 21 is the case where the hardness (Hc) of the cover exceeds 49. Compared to these Golf balls No. 15 and 21 to 23, Golf balls No. 12 to 14 and 16 to 20 travel a greater flight distance on driver shots and have an increased spin rate on approach shots, thereby exhibiting a better performance on approach shots.

This application is based on Japanese Patent Application No. 2015-090786 filed on Apr. 27, 2015, the contents of which are hereby incorporated by reference.

The invention claimed is:

1. A golf ball comprising a spherical core, an intermediate layer positioned outside the spherical core, and a cover positioned outside the intermediate layer, wherein the spherical core includes an inner layer and an outer layer, a difference ($H_{X+1}$−$H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 70 in Shore C hardness, an angle α of a hardness gradient of the inner layer calculated by a formula (1) is 0° or more, a difference (α−β) between the angle α and an angle β of a hardness gradient of the outer layer calculated by a formula (2) is 0° or more, the intermediate layer has a hardness that is highest among the the spherical core and cover of the golf ball, a difference (Hm−Hb) between a hardness (Hm) of the intermediate layer and a surface hardness (Hb) of the golf ball is less than 9 in Shore D hardness, and a difference (Hb−Hc) between the surface hardness (Hb) of the golf ball and a hardness of the cover (Hc) is 22 or more in Shore D hardness, $$\alpha=(180/\pi)\times a\tan[\{H_{x-1}-Hoc\}/(X-1)] \quad (1)$$

$$\beta=(180/\pi)\times a\tan[\{H_{X+Y}-H_{x+1}\}/(Y-1)] \quad (2)$$

where X represents a radius (mm) of the inner layer, Y represents a thickness (mm) of the outer layer, Hoc represents a center hardness (Shore C) of the spherical core, $H_{X-1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core.

2. The golf ball according to claim 1, wherein the hardness (Hc) of the cover is 49 or less in Shore D hardness.

3. The golf ball according to claim 1, wherein a difference (Hm−Hc) between the hardness (Hm) of the intermediate layer and the hardness (Hc) of the cover is 15 or more in Shore D hardness.

4. The golf ball according to claim 1, wherein the center hardness (Hoc) of the spherical core is less than 70 in Shore C hardness.

5. The golf ball according to claim 1, wherein the angle β ranges from −20° to +20°.

6. The golf ball according to claim 1, wherein a ratio (Y/X) of the thickness Y (mm) of the outer layer to the radius X (mm) of the inner layer ranges from 0.2 to 2.0.

7. The golf ball according to claim 1, wherein a ratio (S2/S1) of a cross-sectional area S2 ($mm^2$) of the outer layer to a cross-sectional area S1 ($mm^2$) of the inner layer on a cut plane of the spherical core obtained by cutting the spherical core into two hemispheres ranges from 0.5 to 6.0.

8. The golf ball according to claim 1, wherein a ratio (V2/V1) of a volume V2 ($mm^3$) of the outer layer to a volume V1 ($mm^3$) of the inner layer ranges from 1.0 to 20.0.

9. The golf ball according to claim 1, wherein the intermediate layer includes an inner intermediate layer and an outer intermediate layer positioned outside the inner intermediate layer.

10. The golf ball according to claim 1, wherein the inner layer and the outer layer of the spherical core are formed from a rubber composition.

11. The golf ball according to claim 1, wherein the intermediate layer is formed from a resin composition.

12. The golf ball according to claim 1, wherein the hardness (Hm) of the intermediate layer is 55 or more in Shore D hardness.

13. The golf ball according to claim 1, wherein a thickness Tm of the intermediate layer ranges from 0.8 mm to 1.7 mm.

14. The golf ball according to claim 1, wherein the cover is formed from a resin composition containing a polyurethane as a resin component.

15. The golf ball according to claim 1, wherein a thickness Tc of the cover is 0.9 mm or less.

16. The golf ball according to claim 1, wherein the hardness (Hm) of the intermediate layer, a center hardness (Hod) of the spherical core, and the hardness (Hc) of the cover in Shore D hardness satisfy a following mathematical formula (3):

$$0.6\leq(Hm-Hod)/Hc \quad (3).$$

17. The golf ball according to claim 1, wherein a difference (Hm−Hod) between the hardness (Hm) of the intermediate layer and a center hardness (Hod) of the spherical core is 20 or more in Shore D hardness.

18. The golf ball according to claim 1, wherein the hardness $H_{X-1}$ ranges from 63 to 82 in Shore C hardness, and the hardness $H_{X+1}$ ranges from 72 to 90 in Shore C hardness.

19. The golf ball according to claim 1, wherein the hardness difference ($H_{X+1}-H_{X-1}$) between the hardness $H_{X-1}$ and the hardness $H_{X+1}$ is 5 or more in Shore C hardness.

20. The golf ball according to claim 18, wherein a hardness difference ($H_{X-1}$−Hoc) between the center hardness Hoc and the hardness $H_{X-1}$ ranges from 4 to 27 in Shore C hardness, the hardness difference ($H_{X+1}-H_{X-1}$) between the hardness $H_{X-1}$ and the hardness $H_{X+1}$ ranges from 5 to 20 in Shore C hardness, and a hardness difference ($H_{X+Y}-H_{X+1}$) between the hardness $H_{X+1}$ and the surface hardness $H_{X+Y}$ ranges from −7 to 10 in Shore C hardness.

* * * * *